US009692127B2

(12) United States Patent
Yamagajo et al.

(10) Patent No.: US 9,692,127 B2
(45) Date of Patent: Jun. 27, 2017

(54) ANTENNA DEVICE AND ANTENNA SYSTEM

(71) Applicant: FUJITSU LIMITED, Kawasaki-shi, Kanagawa (JP)

(72) Inventors: Takashi Yamagajo, Yokosuka (JP); Shohei Ishikawa, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 213 days.

(21) Appl. No.: 14/626,657

(22) Filed: Feb. 19, 2015

(65) Prior Publication Data

US 2015/0333407 A1 Nov. 19, 2015

(30) Foreign Application Priority Data

May 13, 2014 (JP) ..... 2014-099460

(51) Int. Cl.
*H01Q 9/04* (2006.01)
*H01Q 5/40* (2015.01)
*H01Q 5/307* (2015.01)

(52) U.S. Cl.
CPC ..... *H01Q 5/40* (2015.01); *H01Q 5/307* (2015.01); *H01Q 9/045* (2013.01); *H01Q 9/0414* (2013.01)

(58) Field of Classification Search
CPC ..... H01Q 5/40; H01Q 9/0414; H01Q 9/045; H01Q 5/307
See application file for complete search history.

(56) References Cited

U.S. PATENT DOCUMENTS

2008/0204326 A1* 8/2008 Zeinolabedin Rafi ..... H01Q 9/0414 343/700 MS
2013/0099982 A1* 4/2013 Andrenko ..... H01Q 5/40 343/700 MS

FOREIGN PATENT DOCUMENTS

| | | | |
|---|---|---|---|
| JP | 63-069301 | A | 10/2003 |
| JP | 2003-283240 | A | 10/2003 |
| JP | 2003-309424 | A | 10/2003 |
| JP | 2005-322972 | A | 11/2005 |

* cited by examiner

*Primary Examiner* — Hoang Nguyen
*Assistant Examiner* — Michael Bouizza
(74) *Attorney, Agent, or Firm* — Arent Fox LLP

(57) ABSTRACT

An antenna device includes: a ground plate; a first patch, provided on one surface side of the ground plate and including two first power feeding portions provided in a region surrounded by a first contour at positions spaced away from a first position with a first distance, configured to resonate with a first frequency; a second patch, provided between the ground plate and the first patch and including two second power feeding portions provided in a region surrounded by a second contour at positions spaced away from a second position with a second distance and a slit formed in the region, configured to resonate with a second frequency lower than the first frequency; and an inter-patch connection portion configured to electrically couple the first position of the first patch and the second position of the second patch.

19 Claims, 32 Drawing Sheets

FIG. 17

| | | INTER-PATCH CONNECTION PORTION | |
|---|---|---|---|
| | | WITHOUT | WITH |
| SLIT | WITHOUT | LOWER-PATCH $S_{11}$ (FIGURE 18)<br>LOWER-PATCH $S_{12}$ (FIGURE 18) | LOWER-PATCH $S_{11}$ (FIGURE 24)<br>HIGHER-PATCH $S_{21}$ (FIGURE 19) , LOWER-PATCH $S_{12}$ (FIGURE 24)<br>HIGHER-PATCH GAIN (FIGURE 20) |
| | WITH | LOWER-PATCH $S_{12}$ (FIGURE 18) | HIGHER-PATCH $S_{11}$ (FIGURE 26) , LOWER-PATCH $S_{11}$ (FIGURE 25,FIGURE 26)<br>HIGHER-PATCH $S_{21}$ (FIGURE 19) , LOWER-PATCH $S_{12}$ (FIGURE 22,FIGURE 25)<br>HIGHER-PATCH GAIN (FIGURE 20,FIGURE 21) |

ANTENNA DEVICE AND ANTENNA SYSTEM

CROSS-REFERENCE TO RELATED APPLICATION

This application is based upon and claims the benefit of priority of the prior Japanese Patent Application No. 2014-099460, filed on May 13, 2014, the entire contents of which are incorporated herein by reference.

FIELD

The embodiments discussed herein are related to an antenna device and an antenna system.

BACKGROUND

A patch antenna is used as a multi-frequency shared antenna that resonates with frequencies different from each other.

Japanese Laid-open Patent Publication No. 2003-309424 is an example of the related art.

SUMMARY

According to an aspect of the embodiment, an antenna device includes: a ground plate; a first patch, provided on one surface side of the ground plate and including two first power feeding portions provided in a region surrounded by a first contour at positions spaced away from a first position with a first distance, configured to resonate with a first frequency; a second patch, provided between the ground plate and the first patch and including two second power feeding portions provided in a region surrounded by a second contour at positions spaced away from a second position with a second distance and a slit formed in the region, configured to resonate with a second frequency lower than the first frequency; and an inter-patch connection portion configured to electrically couple the first position of the first patch and the second position of the second patch.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 17 illustrates an example of classification of a graph illustrating a simulation result.

DESCRIPTION OF EMBODIMENTS

Figure 1:
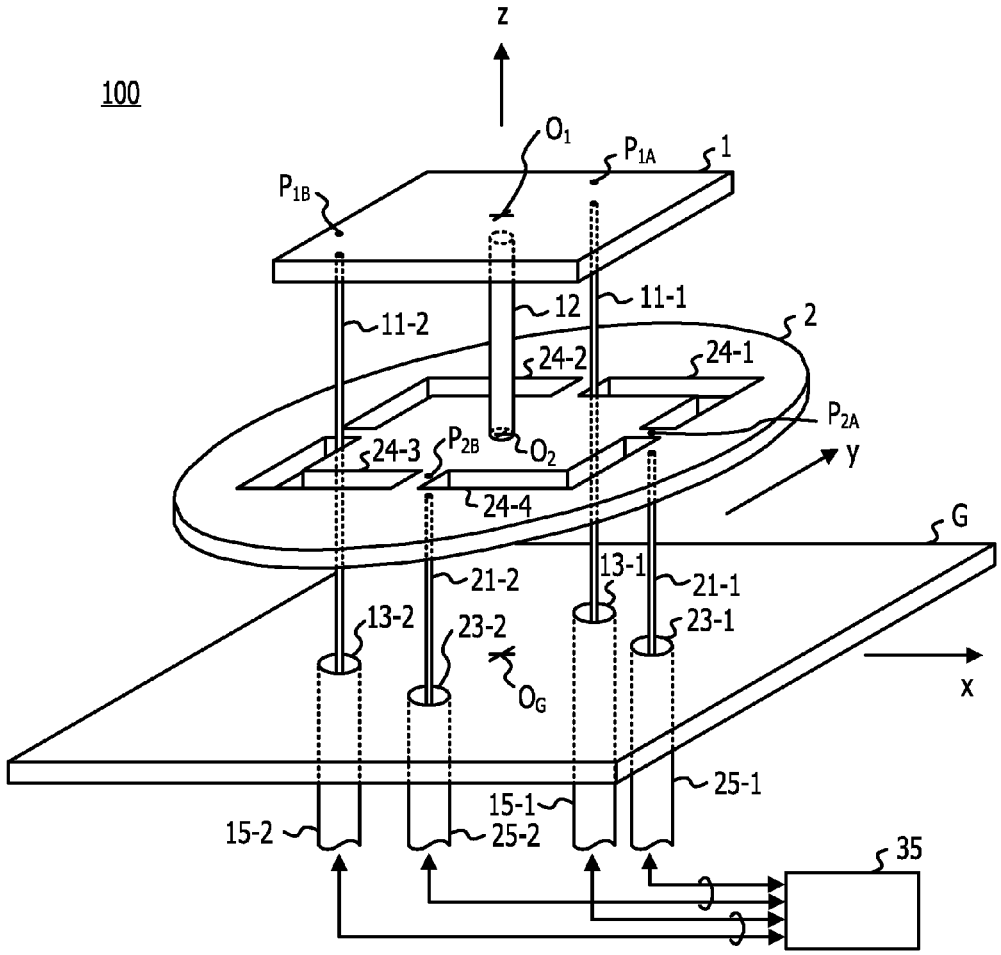
FIG. 1 illustrates an example of an antenna device.

For example, a multi-frequency shared antenna includes a ground plate, a plurality of patch antenna elements for different frequencies which are laminated on an upper side of the ground plate with an interval therebetween, a plurality of conductive support units each supporting the center of each of the patch antenna elements to a patch antenna element on a lower side or to the ground plate, and a plurality of power feeding units each being coupled to a certain position of each of the patch antenna elements.

The multi-frequency shared antenna, which uses the plurality of patch antenna elements (patches), forms a laminated patch antenna that resonates with a plurality of frequencies. In the laminated patch antenna, the plurality of patches may be provided at positions close to each other for miniaturization. According to this, the plurality of patches may be electromagnetically coupled to each other or interfere each other in accordance with a frequency that is used, and thus antenna characteristics may deteriorate.

In the drawings, the same reference numeral or the same reference sign is given to the same or similar element.

The antenna device may be a laminated patch antenna that resonates with a plurality of frequencies. The laminated patch antenna may be referred to as a stacked patch antenna. The antenna device may be referred to as a multi-band patch antenna. For example, the antenna device may be used in a base station, an access point, a router, a reader/writer (R/W) of a wireless tag, and the like. A plurality of frequencies may be arbitrary frequencies which are determined in accordance with a communication environment in which the antenna device is used. For example, the plurality of frequencies may include frequencies of a frequency band of 5 GHz and a frequency band of 2 GHz. For example, the frequency band of 5 GHz may be determined based on standard specification IEEE802.11a of a wireless local area network (WLAN), and as an example, frequencies such as 5.15 GHz to 5.35 GHZ, and 5.47 GHz to 5.2725 GHz may be used. For example, the frequency band of 2 GHz may be determined based on a standard specification IEEE802.11b of a wireless local area network, and as an example, frequencies such as 2.4 GHz to 2.5 GHz may be used.

FIG. 1 illustrates an example of an antenna device. In FIG. 1, attention is paid to a conductive layer of an antenna device 100. For example, an insulating layer disposed between conductive layers may be omitted in FIG. 1. The antenna device 100 includes at least a ground plate G that is provided on an xy plane, a first patch 1 that is provided on one side of the ground plate G, a second patch 2 that is provided between the ground plate G and the first patch 1, and an inter-patch connection portion 12.

Figure 2:
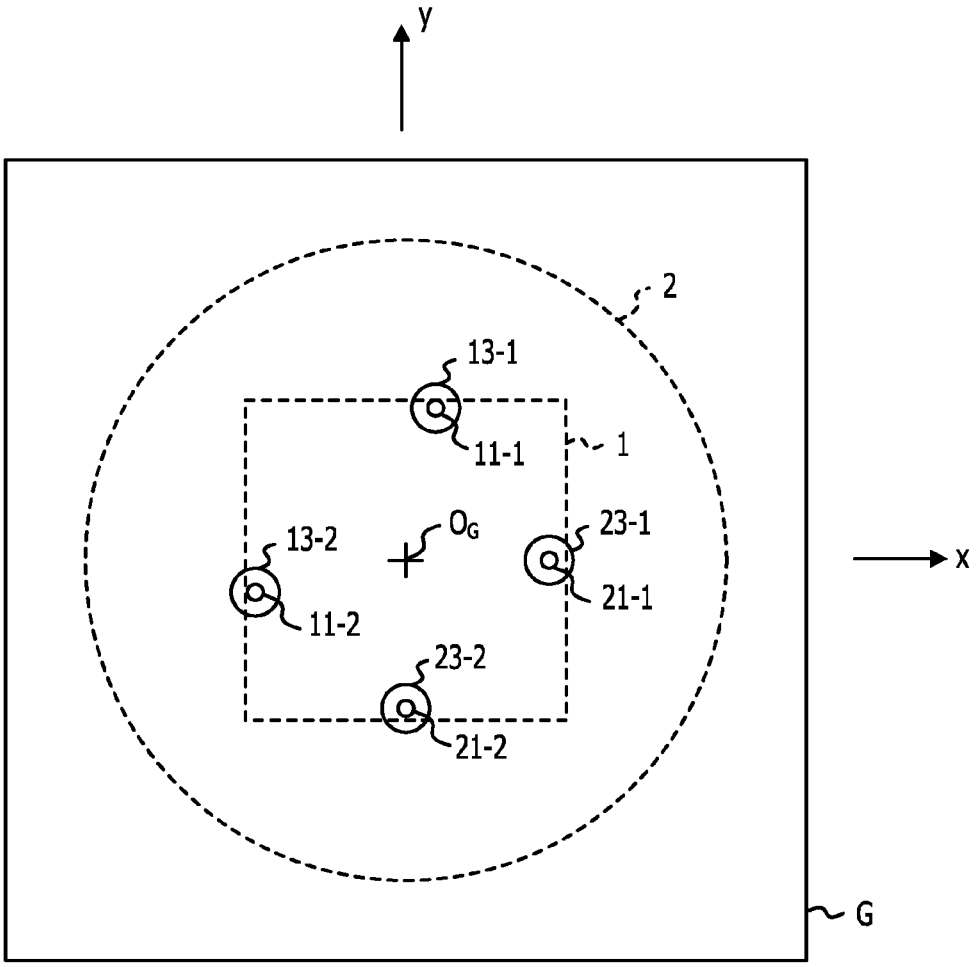
FIG. 2 illustrates an example of a ground plate.

The ground plate G may be referred to as a ground conductor, a ground plane, a GND, and the like. The ground plate G may be formed from a metal plate, or may be conductive pattern that is formed on an insulating layer and is processed. The ground plate G may have appropriate arbitrary shape and size, and may have a size larger than that of the first and second patches 1 and 2. As an example, the ground plate G has a planar shape that is point-symmetric about the origin $O_G$. In FIG. 1, the ground plate G has a square shape. The ground plate G is formed from an appropriate arbitrary material with high conductivity. FIG. 2 illustrates an example of a ground plate. In FIG. 2, a plan view of the ground plate G illustrated in FIG. 1 is illustrated. Two power feeding lines 11-1 and 11-2 are electrically coupled to the first patch 1 on one side (in a z-axis positive direction). Two power feeding lines 21-1 and 21-2 are also electrically coupled to the second patch 2 on one side. The four power feeding lines 11-1, 11-2, 21-1, and 21-2 respectively pass through penetration holes 13-1, 13-2, 23-1, and 23-2 and penetrate through the ground plate G, and are coupled to a power feeding circuit 35 (FIG. 1) through coaxial cables 15-1, 15-2, 25-1, and 25-2, respectively.

The power feeding line 11-1 and an insulating material portion that exists around the power feeding line 11-1 are included on an inner side of the penetration hole 13-1. The power feeding line 11-2 and an insulating material portion that exists around the power feeding line 11-2 are included on an inner side of the penetration hole 13-2. The power feeding line 21-1 and an insulating material portion that exists around the power feeding line 21-1 are included on an inner side of the penetration hole 23-1. The power feeding line 21-2 and an insulating material portion that exists around the power feeding line 21-2 are included on an inner side of the penetration hole 23-2.

Figure 3:
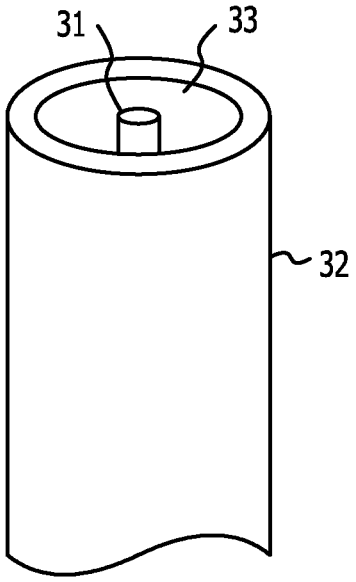
FIG. 3 illustrates an example of a coaxial cable.

FIG. 3 illustrates an example of a coaxial cable. The coaxial cable includes an inner conductor 31, a tubular outer conductor 32 that surrounds the inner conductor 31, and an insulating material portion 33 that is interposed between the inner conductor 31 and the outer conductor 32. For example, the inner conductor 31 of the coaxial cable corresponding to the reference numeral 15-1 of FIG. 1 may be coupled to the power feeding line 11-1, and the outer conductor 32 may be coupled to the ground plate G. The inner conductor 31 of the coaxial cable corresponding to the reference numeral 15-2 may be coupled to the power feeding line 11-2, and the outer conductor 32 may be coupled to the ground plate G. The inner conductor 31 of the coaxial cable corresponding to the reference numeral 25-1 may be coupled to the power feeding line 21-1, and the outer conductor 32 may be coupled to the ground plate G. The inner conductor 31 of the coaxial cable corresponding to reference numeral 25-2 may be coupled to the power feeding line 21-2, and the outer conductor 32 may be coupled to the ground plate G.

In FIGS. 1, 2, and 3, the power feeding circuit 35 may be coupled to the first and second patches 1 and 2 through the coaxial cables, and may be coupled to the first and second patches 1 and 2 through an appropriate arbitrary power feeding method. For example, the power feeding circuit 35 may be coupled to the first and second patches 1 and 2 through a microstrip line, a coplanar line, and the like.

In FIGS. 1 and 2, power feeding of the two patches of the first and second patches 1 and 2 is performed by a two-point power feeding method, respectively, and thus a total of four power feeding lines are used. For example, three or more patches may be provided to the antenna device, and six or more power feeding lines and penetration holes may be provided.

As illustrated in FIG. 1, the antenna device 100 includes the first patch 1. The first patch 1 is provided to be spaced away from the ground plate G with an appropriate distance on one surface side of the ground plate G (in FIG. 1, the z-axis positive direction). To increase the gain of the antenna device 100, the first patch 1 may be provided at a distance far away from the ground plate G. However, the position and the height of the first patch 1 may be determined with limitation from the viewpoint of miniaturization and the like. For example, the first patch 1 may be provided at a height of approximately 4.5 mm from the ground plate G. The first patch 1 may be formed from an appropriate arbitrary conductive material with high conductivity. For example, the first patch 1 may be formed from copper (Cu), gold (Au), silver (Ag), stainless steel, and the like.

Figure 4:
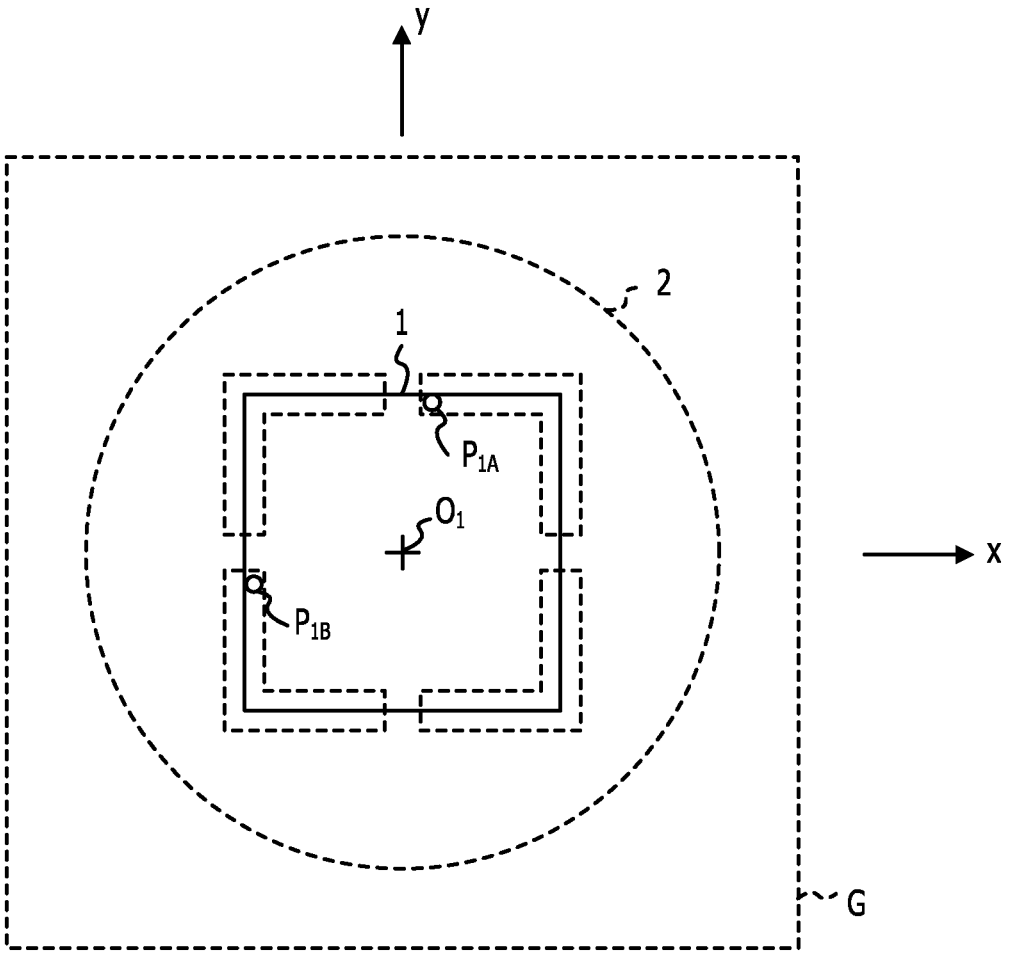
FIG. 4 illustrates an example of a first patch.

FIG. 4 illustrates an example of a first patch. In FIG. 4, a plan view of the first patch 1 illustrated in FIG. 1 is illustrated. The first patch 1 has a shape, a size, and the like to resonate with a first frequency. The first frequency may be appropriate arbitrary frequency. For example, the first frequency may be set to a frequency band of 5 GHz. The first patch 1 may have a first contour having a planar shape that is symmetric about the center $O_1$. The term "symmetric about an arbitrary point" represents point symmetry, line symmetry, approximate point symmetry, or approximate line symmetry about the arbitrary point. For example, the first patch 1 may have a shape such as a rectangular shape, a circular shape, and a polygonal shape in a plan view. In FIGS. 1 and 4, the first patch 1 has a square contour. For example, the first patch 1 may have a square contour in which the length of one side is approximately 26 mm, and may have a thickness of approximately 50 μm. For example, in FIGS. 1, 2, and 4, the origin $O_G$ in the ground plate G, and the center $O_1$ of the first patch 1 may exist on a z-axis.

The first patch 1 includes a pair of power feeding portions $P_{1A}$ and $P_{1B}$. The power feeding portion $P_{1A}$ on one side is connected to the power feeding line 11-1 (FIG. 1). The power feeding portion $P_{1B}$ on the other side is connected to the power feeding line 11-2 (FIG. 1). The pair of power feeding portions $P_{1A}$ and $P_{1B}$ is provided at positions spaced away from the center $O_1$ with a certain distance. For example, the power feeding portion $P_{1A}$ on one side may be provided at a position at which a power-feeding impedance at the position of the power feeding portion $P_{1A}$ on one side reaches a certain matching impedance. Similarly, the power feeding portion $P_{1B}$ on the other side may be provided at a position at which the power-feeding impedance at the position of the power feeding portion $P_{1B}$ on the other side reaches a certain matching impedance. For example, the certain matching impedance may be a value such as 50 ohms and 75 ohms. When the voltage and the phase of a signal that flows to the power feeding portion $P_{1A}$ on one side, and the voltage and the phase of a signal that flows to the power feeding portion $P_{1B}$ on the other side are appropriately controlled, the first patch 1 transmits and receives an arbitrary polarized wave. For example, the first patch 1 may transmit and receive a linearly polarized wave or a circularly polarized wave. For simplification of control of the polarized wave, an angle $P_{1A}O_1P_{1B}$ may be substantially 90°.

As illustrated in FIG. 1, the antenna device 100 includes the second patch 2. The second patch 2 is provided between the ground plate G and the first patch 1. For example, the second patch 2 is provided at a height that is lower than that of the first patch 1 on one surface side of the ground plate G (in FIG. 1, the z-axis positive direction). To increase the gain of the antenna device 100, the second patch 2 may be provided at a distance far away from the ground plate G, and the position and the height of the second patch 2 may also be determined with limitation for miniaturization. For example, the second patch 2 may be provided at a height of approximately 3.0 mm from the ground plate G. The second patch 2 may be formed from an appropriate arbitrary conductive material with high conductivity. For example, the second patch 2 may be formed from copper (Cu), gold (Au), silver (Ag), stainless steel, and the like.

Figure 5:
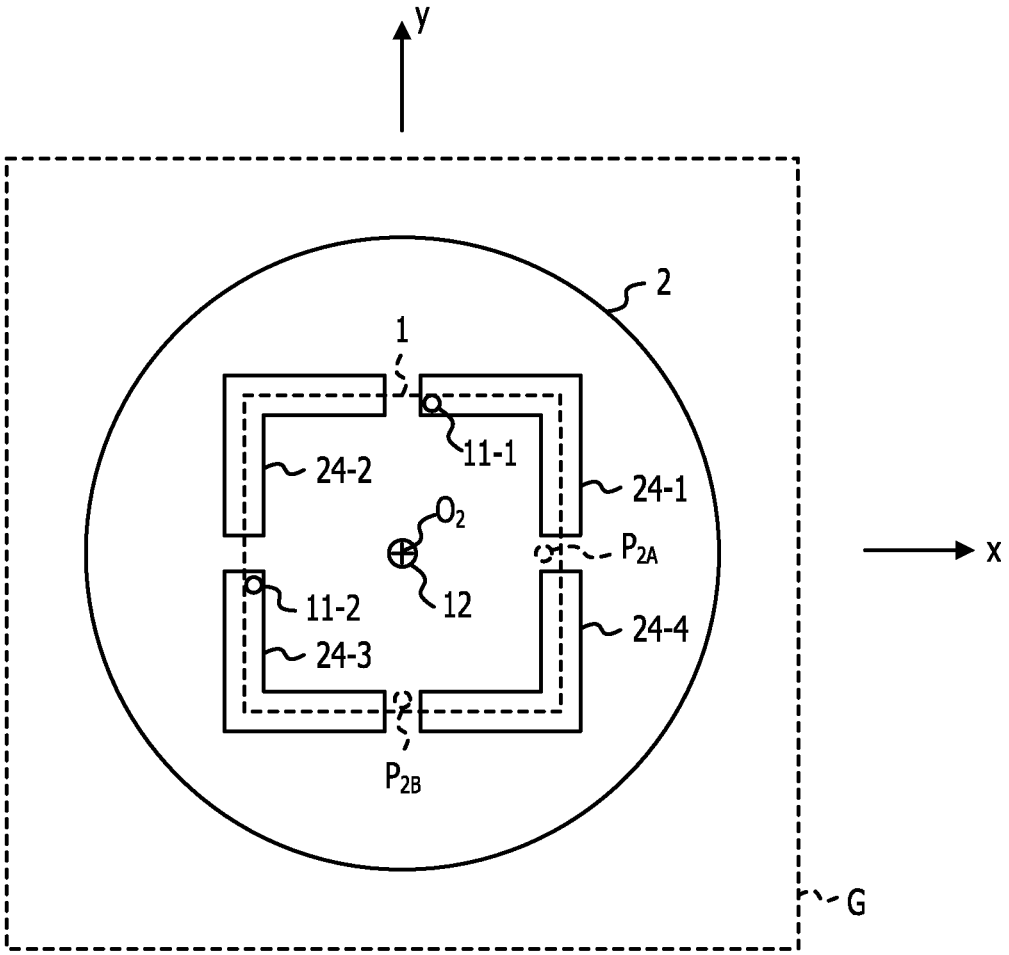
FIG. 5 illustrates an example of a second patch.

FIG. 5 illustrates an example of a second patch. In FIG. 5, a plan view of the second patch 2 illustrated in FIG. 1 is illustrated. The second patch 2 may have a shape, a size, and the like to resonate with a second frequency. The second frequency may be an appropriate arbitrary frequency lower than the first frequency. For example, the second frequency may be set to a frequency band of 2 GHz. The second patch 2 may have a second contour having a planar shape that is symmetric about the center $O_2$. For example, the second patch 2 may have a shape such as a rectangular shape, a circular shape, and a polygonal shape in a plan view. In FIGS. 1 and 5, the second patch 2 may have a circular contour. For example, the second patch 2 may have a circular contour in which a diameter length is approximately 60 mm, and may have a thickness of approximately 50 μm. With regard to FIGS. 1, 2, and 5, the origin $O_G$ in the ground plate G, the center $O_1$ of the first patch 1, and the center $O_2$ of the second patch 2 may exist on the z-axis.

The second patch 2 includes a pair of power feeding portions $P_{2A}$ and $P_{2B}$. The power feeding portion $P_{2A}$ on one side is coupled to the power feeding line 21-1 (FIG. 1). The power feeding portion $P_{2B}$ on the other side is connected to the power feeding line 21-2 (FIG. 1). The pair of power feeding portions $P_{2A}$ and $P_{2B}$ is provided at positions spaced away from the center $O_2$ with a certain distance. For example, the power feeding portion $P_{2A}$ on one side may be provided at a position at which a power-feeding impedance at the position of the power feeding portion $P_{2A}$ on one side reaches a certain matching impedance. Similarly, the power feeding portion $P_{2B}$ on the other side may be provided at a position at which a power-feeding impedance at the position of the power feeding portion $P_{2B}$ on the other side reaches a certain matching impedance. For example, the certain matching impedance may be a value such as 50 ohms and 75 ohms. When the voltage and the phase of a signal that flows through the power feeding portion $P_{2A}$ on one side, and the voltage and the phase of a signal that flows through the power feeding portion $P_{2B}$ on the other side are appropriately controlled, the second patch 2 transmits and receives an arbitrary polarized wave. For example, the second patch 2 may transmit and receive a linearly polarized wave or a circularly polarized wave. For simplification of control of the polarized wave, an angle $P_{2A}O_2P_{2B}$ may be substantially 90°.

The second patch 2 includes a slit. The slit forms an elongated hole obtained by removing a conductive material. In FIGS. 1 and 5, a first slit 24-1 is formed in a first quadrant (x>0, y>0), and a second slit 24-2 is formed in a second quadrant (x<0, y>0), a third slit 24-3 is formed in a third quadrant (x<0, y<0), and a fourth slit 24-4 is formed at a fourth quadrant (x>0, y<0). A slit position, a slit number, a slit shape, and the like which are illustrated in FIGS. 1 and 5 are illustrative only, and one or more slits having an appropriate arbitrary shape may be formed. Each of the slits may have a shape conforming to at least a part of the contour of the first patch 1 in a plan view. For example, as illustrated in FIG. 5, a region of the first slit 24-1 may overlap a part of the square contour of the first patch 1, for example, a portion that pertains to the first quadrant. Similarly, a region of the second slit 24-2 may overlap a part of the square contour of the first patch 1, for example, a portion that pertains to the second quadrant. A region of the third slit 24-3 may overlap a part of the square contour of the first patch 1, for example, a portion that pertains to the third quadrant. A region of the fourth slit 24-4 may overlap a part of the square contour of the first patch 1, for example, a portion that pertains to the fourth quadrant.

The power feeding line 11-1, which extends from the power feeding portion $P_{1A}$ of the first patch 1, penetrates through the first slit 24-1 and penetrates through the penetration hole 13-1 of the ground plate G. On an inner side of a hole formed by the first slit 24-1 illustrated in FIG. 5, a portion other than the power feeding line 11-1 is filled with an insulating material. The insulating material in the hole exists to surround the power feeding line 11-1, and thus the power feeding line 11-1 penetrates through the slit 24-1 without electrical contact with the second patch 2. Similarly, the power feeding line 11-2, which extends from the power feeding portion $P_{1B}$ of the first patch 1, penetrates through the third slit 24-3 and penetrates through the penetration hole 13-2 of the ground plate G. On an inner side of a hole formed by the third slit 24-3, a portion other than the power feeding line 11-2 is filled with an insulating material. The insulating material in the hole exists to surround the power feeding line 11-2, and thus the power feeding line 11-2 penetrates through the slit 24-2 without electrical contact with the second patch 2. Holes formed by the second and fourth slits 24-2 and 24-4 are filled with the insulating material, respectively.

The first to fourth slits 24-1 to 24-4 which are formed in the second patch 2 may be formed in various manners in accordance with the shape of the first patch 1. The number of slits may be four, or an arbitrary number that is equal to or greater than 1. For example, the slit may be formed at a plurality of positions which are symmetric about the center $O_2$ so as to equalize control of a polarized wave with respect to an x-axis direction, and control of a polarized wave with respect to a y-axis direction.

Figure 6:
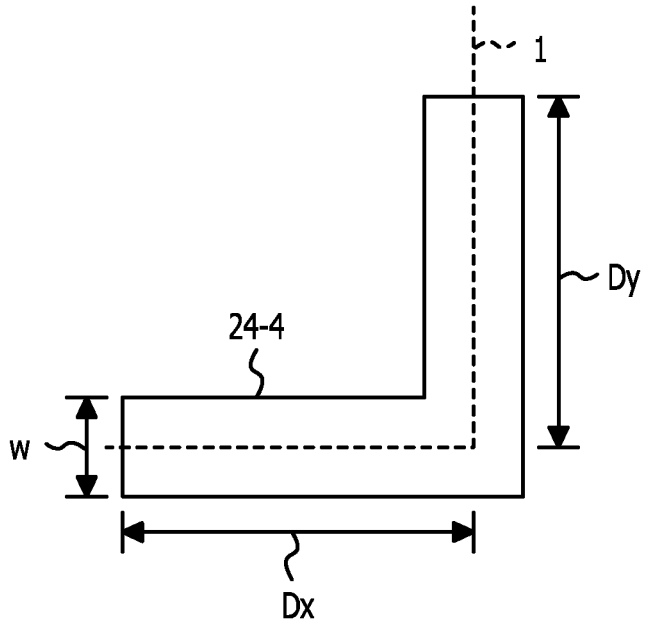
FIG. 6 illustrates an example of a slit.

FIG. 6 illustrates an example of a slit. The slit illustrated in FIG. 6 may be the fourth slit 24-4 illustrated in FIG. 5. The slit has a length Dx in the x-axis direction, and a length Dy and a width w in the y-axis direction. The total of the length Dx in the x-axis direction and the length Dy in the y-axis direction represents the length of the slit, and the width w represents the slit width. The same length and width may be set in the other slits 24-1, 24-2, and 24-3. In FIG. 6, the slit has an L-shape that is bent in accordance with the angle of the first patch 1.

Figure 7:
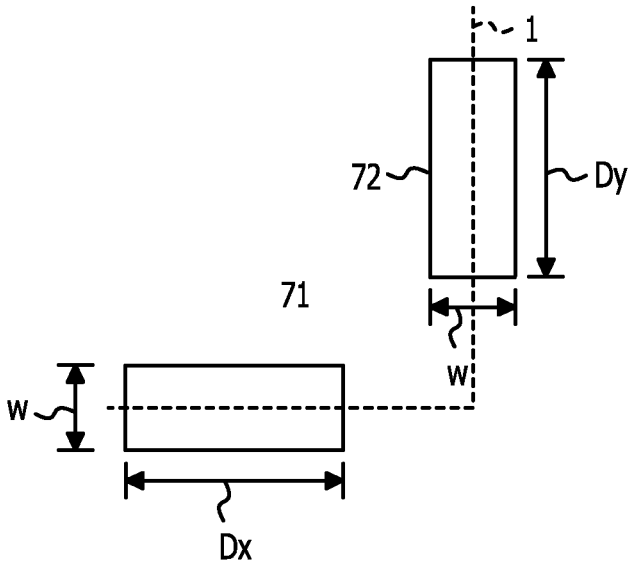
FIG. 7 illustrates an example of a slit.

FIG. 7 illustrates an example of a slit. The slit illustrated in FIG. 7 has a strip shape that is not bent. In FIG. 7, a strip-shaped slit 71 having a length Dx in the x-axis direction and a width w, and a strip-shaped slit 72 having a length Dy in the y-axis direction and a width w are formed.

Figure 8:
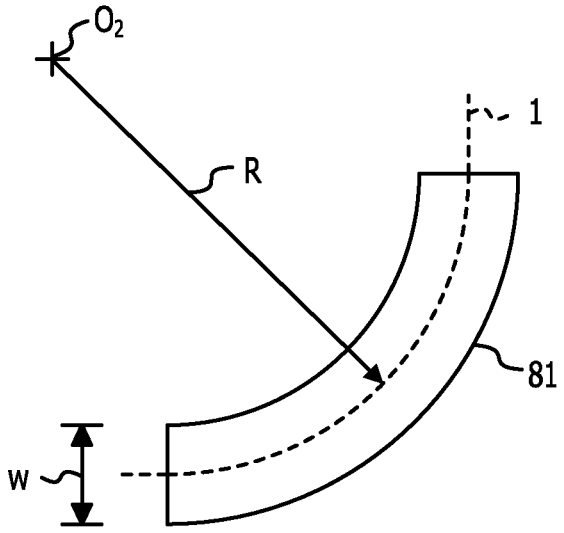
FIG. 8 illustrates an example of a slit.

FIG. 8 illustrates an example of the slit. Unlike in FIGS. 1, 5, 6, and 7, in FIG. 8, the first patch 1 is assumed to have a curvature shape or a circular shape of a radius R. In FIG. 8, a slit 81 is formed along an arc having a width w and the radius R. The length of the arc may represent the length of the slit.

As illustrated in FIG. 1, the antenna device 100 includes an inter-patch connection portion 12 that electrically couples a central portion (region including the center $O_1$) of the first patch 1 and a central portion (region including the center $O_2$) of the second patch 2. The electrical connection may be short-circuited. The inter-patch connection portion 12 may be formed as one line conforming to a line segment (central line or central axis $O_1O_2$) that couples the center $O_1$ of the first patch 1 and the center $O_2$ of the second patch 2, or may be formed as a plurality of lines (a bundle of lines). In a case where the inter-patch connection portion 12 is formed as the plurality of lines along the central line $O_1O_2$, the plurality of lines may be disposed at positions which are symmetric about the central line $O_1O_2$ so as to equalize positional relationships with respect to the pair of power feeding portions $P_{1A}$ and $P_{1B}$ (or $P_{2A}$ and $P_{2B}$). The term "symmetric about the central line" represents line symmetry or approximate line symmetry about the central line. The term "symmetric about the central line" represents point symmetry on a cross-section perpendicular to the central line or approximate point symmetry on a cross-section perpendicular to the central line.

Figure 9:
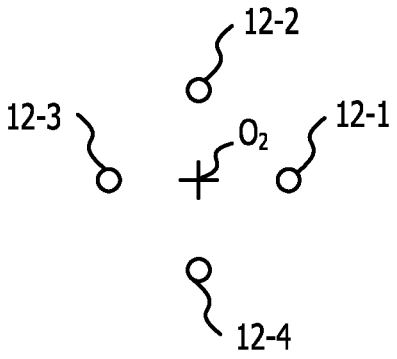
FIG. 9 illustrates an example of a patch connection portion.

FIG. 9 illustrates an example of a patch connection portion. In FIG. 9, four lines 12-1 to 12-4 are disposed at positions which are symmetric about the central line $O_1O_2$ along the z-axis.

Figure 10:
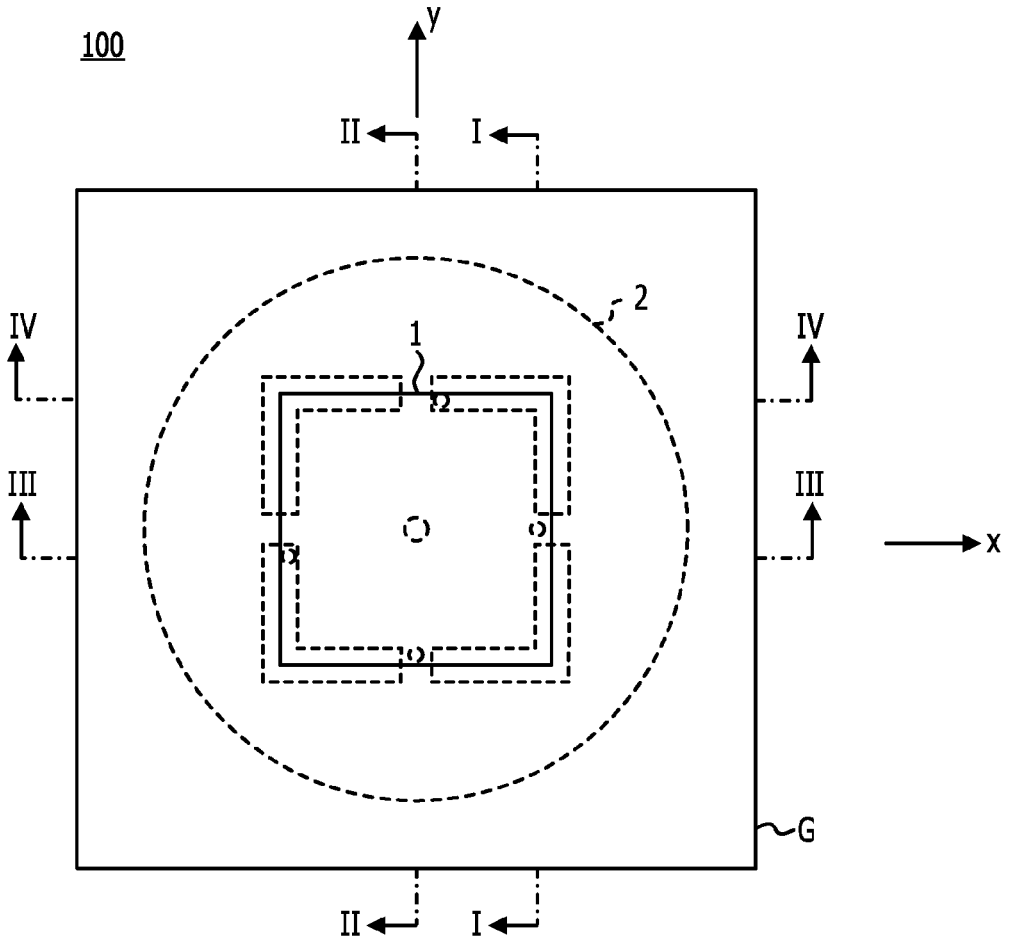
FIG. 10 illustrates an example of a plan view of an antenna device.

FIG. 10 illustrates an example of a plan view of an antenna device. The antenna device illustrated in FIG. 10 may be the antenna device 100 illustrated in FIG. 1.

Figure 11:
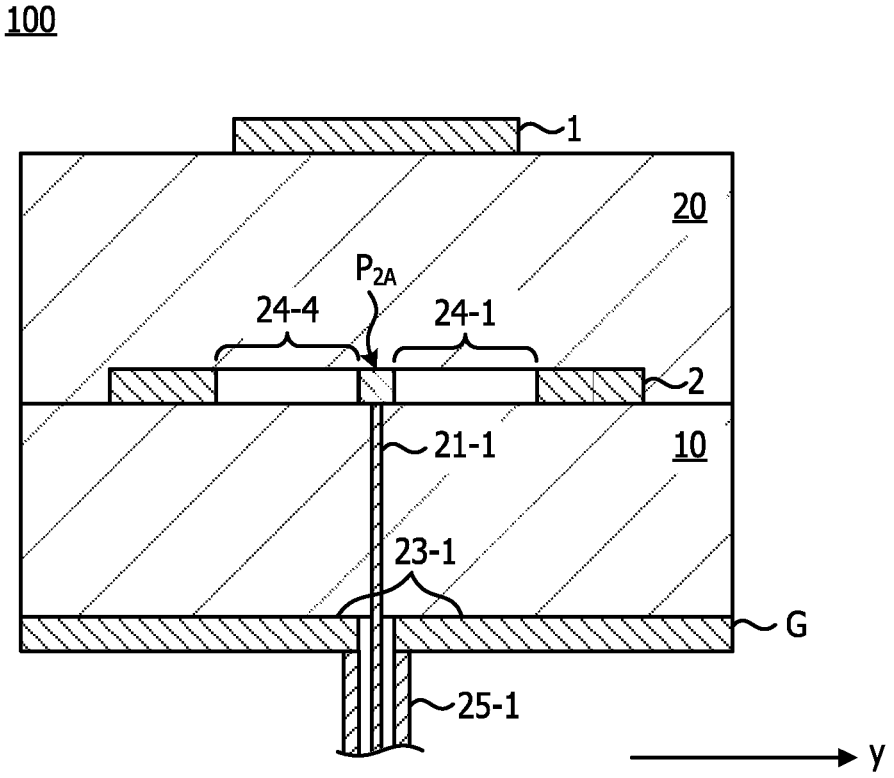
FIG. 11 illustrates an example of a cross-sectional view of an antenna device.

FIG. 11 illustrates an example of a cross-sectional view of an antenna device. FIG. 11 illustrates a cross-sectional view taken along line I-I illustrated in FIG. 10. The antenna device 100 includes a ground plate G, a first insulating layer 10 provided on the ground plate G, a second patch 2 provided on the first insulating layer 10, a second insulating layer 20 provided on the second patch 2, and a first patch 1 provided on the second insulating layer 20. The first and second insulating layers 10 and 20 may be formed by using an existing insulating substrate, and may be formed by using a process of forming and processing an insulating material. The first and second insulating layers 10 and 20 may be formed from an appropriate arbitrary material. For example, materials such as a glass epoxy resin, styrene foam, a fluorine resin, ceramics, and Teflon (registered trademark) may be used. To suppress energy loss, a material having a small dielectric tangent (tan δ) may be used. For reduction in weight of the antenna device, a material such as the styrene foam may be used.

In FIG. 11, the power feeding line 21-1, which is coupled to the power feeding portion $P_{2A}$ of the second patch 2, penetrates through the first insulating layer 10, penetrates through the ground plate G through the penetration hole 23-1, and is coupled to the inner conductor of the coaxial cable 25-1.

Figure 12:
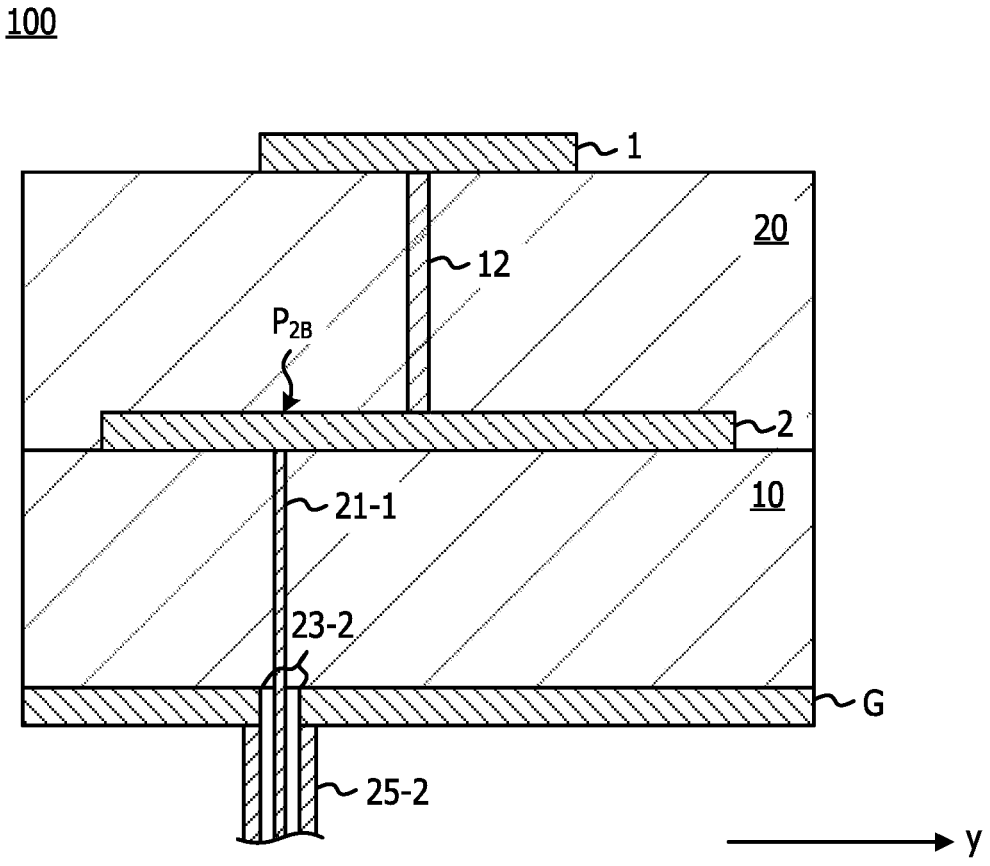
FIG. 12 illustrates an example of a cross-sectional view of an antenna device.

FIG. 12 illustrates an example of a cross-sectional view of an antenna device. FIG. 12 illustrates a cross-sectional view taken along line II-II illustrated in FIG. 10. In FIG. 12, the inter-patch connection portion 12 that couples the first patch 1 and the second patch 2 penetrates through the second insulating layer 20. In FIG. 12, the power feeding line 21-2, which is coupled to the power feeding portion $P_{2B}$ of the second patch 2, penetrates through the first insulating layer 10, penetrates through the ground plate G through the penetration hole 23-2, and is coupled to the inner conductor of the coaxial cable 25-2.

Figure 13:
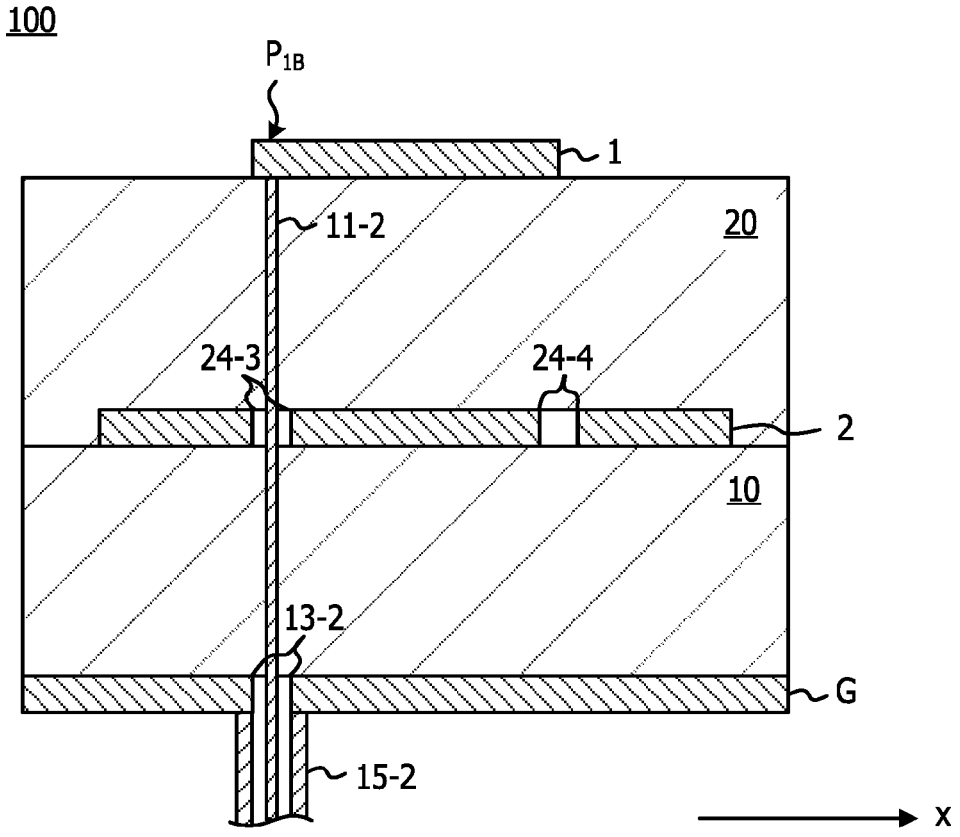
FIG. 13 illustrates an example of a cross-sectional view of an antenna device.

FIG. 13 illustrates an example of a cross-sectional view of an antenna device. FIG. 13 illustrates a cross-sectional view taken along line III-III illustrated in FIG. 10. In FIG. 13, the power feeding line 11-2, which is coupled to the power feeding portion $P_{1B}$ of the first patch 1, penetrates through the second insulating layer 20, penetrates through the third slit 24-3, penetrates through the first insulating layer 10, penetrates through the ground plate G through the penetration hole 13-2, and is coupled to the inner conductor of the coaxial cable 15-2.

Figure 14:
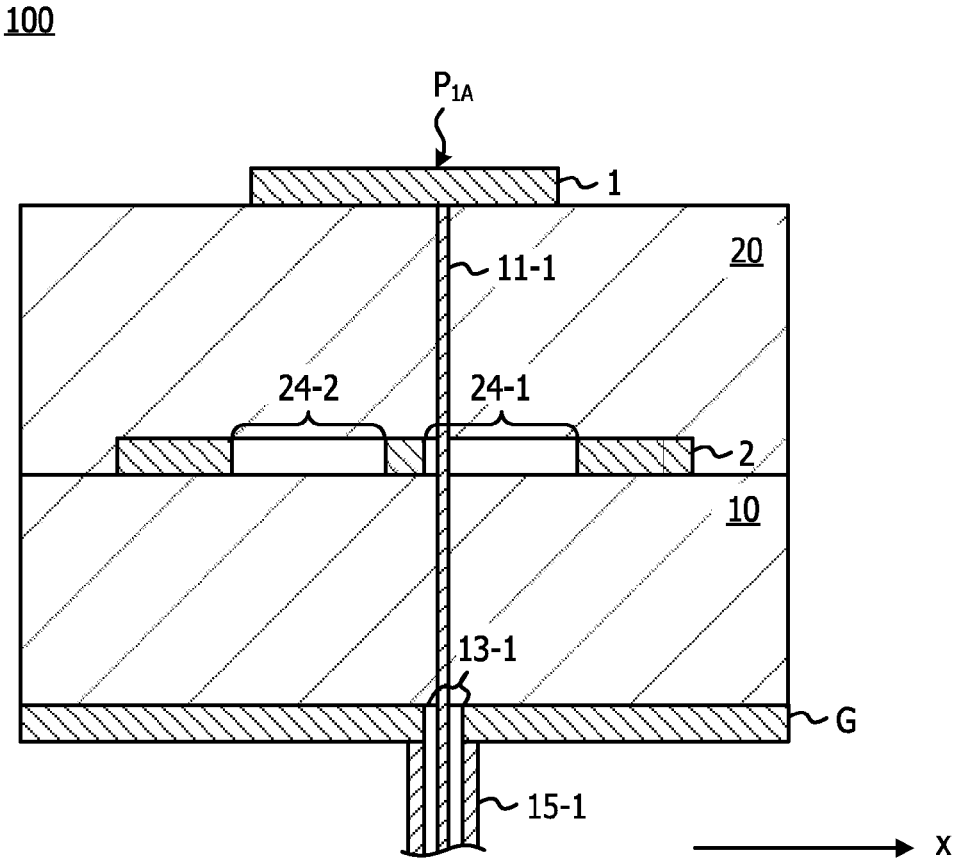
FIG. 14 illustrates an example of a cross-sectional view of the antenna device.

FIG. 14 illustrates an example of a cross-sectional view of an antenna device. FIG. 14 illustrates a cross-sectional view taken along line IV-IV illustrated in FIG. 10. In FIG. 14, the power feeding line 11-1, which is coupled to the power feeding portion $P_{1A}$ of the first patch 1, penetrates through the second insulating layer 20, penetrates the first slit 24-1, penetrates through the first insulating layer 10, penetrates through the ground plate G through the penetration hole 13-1, and is coupled to the inner conductor of the coaxial cable 15-1.

The positions of the power feeding portion $P_{1A}$ and $P_{1B}$ of the first patch 1 depend on a wavelength of an electric wave, the material of the insulating layer (for example, a specific dielectric constant), patch size, and the like, and thus the slit may not exist immediately below the power feeding portion $P_{1A}$ and $P_{1B}$. In a case where the slit does not exist immediately below the power feeding portion $P_{1A}$ and $P_{1B}$, when coupling the power feeding portion $P_{1A}$ and $P_{1B}$ to the coaxial cables 15-1 and 15-2 at positions immediately below the power feeding portion $P_{1A}$ and $P_{1B}$, a penetration hole may be formed separately in the second patch 2. The power feeding line may be bent instead of separately providing the penetration hole separately.

Figure 15:
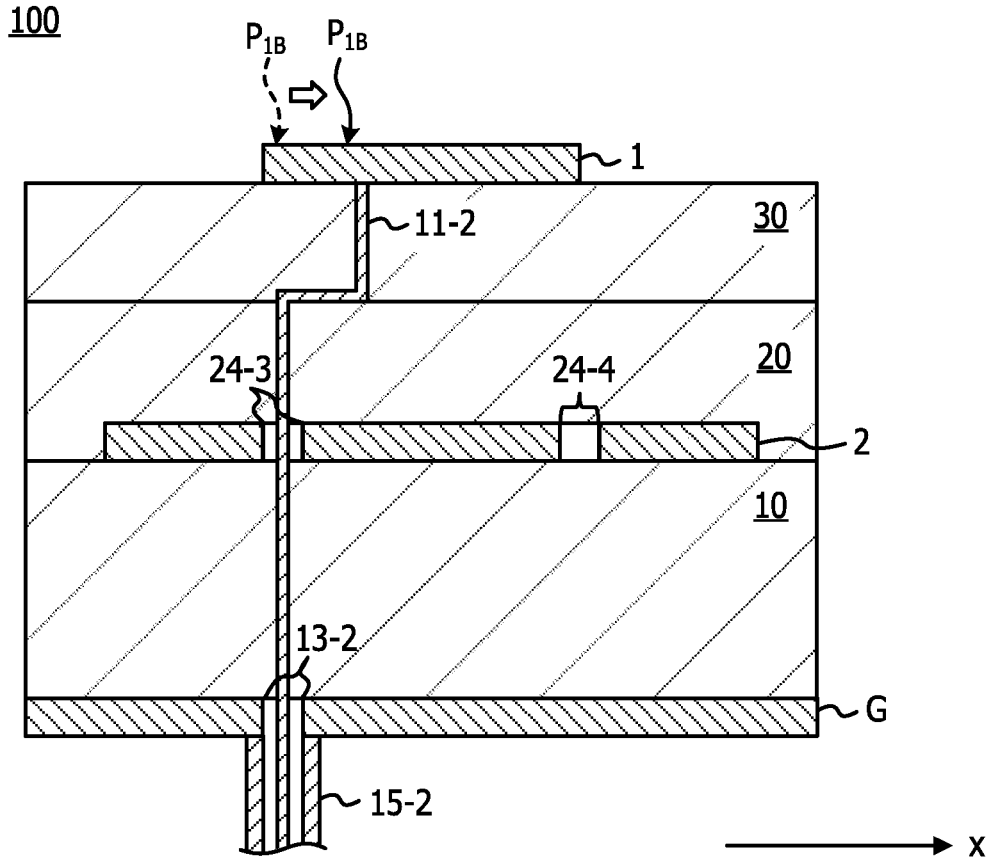
FIG. 15 illustrates an example of a power feeding line.

FIG. 15 illustrates an example of a power feeding line. In FIG. 15, in a case where the position of the power feeding portion $P_{1B}$ of the first patch 1 illustrated in FIG. 13 deviates toward the right side (an x-axis positive direction) in the drawing, the power feeding line 11-2 is bent and the third slit 24-3 is utilized. The power feeding line 11-2, which is coupled to the power feeding portion $P_{1B}$ of the first patch 1, penetrates a third insulating layer 30, extends between the second and third insulating layers 20 and 30 in a direction (an x-axis negative direction) to be distant from the center therebetween, penetrates through the second insulating layer 20, and penetrates through the third slit 24-3. Similar to FIG. 13, the power feeding line 11-2 penetrates through the first insulating layer 10, penetrates through the ground plate G through the penetration hole 13-2, and is coupled to the inner conductor of the coaxial cable 15-2.

The antenna device 100, which is illustrated in FIG. 1 and the like, resonates with the first frequency by the first patch 1, and resonates with the second frequency lower than the first frequency by the second patch 2. The first and second frequencies may be appropriate arbitrary frequencies. For example, the first frequency may be a frequency that pertains to a frequency band of 5 GHz, and the second frequency may be a frequency that pertains to a frequency band of 2 GHz. For convenience, the first patch 1 is referred to as a high-frequency patch 1, and the second patch 2 may be referred to as a low-frequency patch 2.

Figure 16:
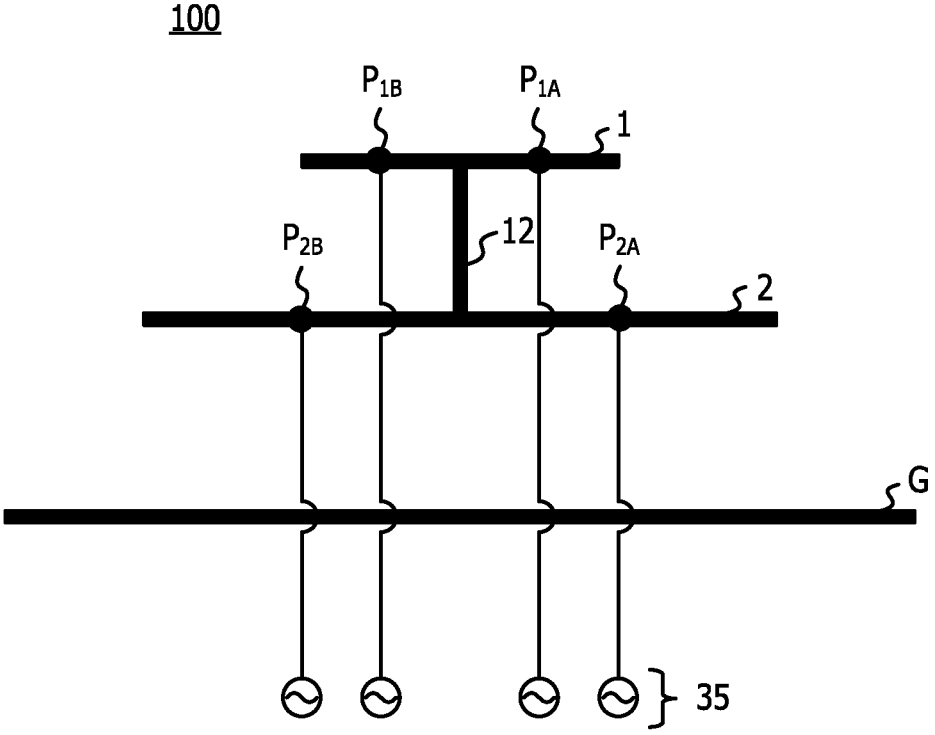
FIG. 16 illustrates an example of an antenna device.

FIG. 16 illustrates an example of an antenna device. FIG. 16 illustrates a circuit diagram of the antenna device 100 that is illustrated in FIG. 1 and the like. In a case of transmitting an electric wave with the high-frequency patch 1, when a high-frequency signal is fed from the power feeding circuit 35 to the pair of power feeding portions $P_{1A}$ and $P_{1B}$, an electric wave is transmitted in the z-axis direction. When the voltage and the phase of the high-frequency signal that flows to each of the pair of power feeding portions $P_{1A}$ and $P_{1B}$ are appropriately controlled, an arbitrary polarized wave such as a linearly polarized wave, an elliptically polarized wave, and a circularly polarized wave is generated. In a case of receiving an electric wave by the high-frequency patch 1, a high-frequency signal is generated in the pair of power feeding portions $P_{1A}$ and $P_{1B}$ due to the electric wave received from the z-axis direction, and the generated high-frequency signal is applied to the power feeding circuit 35. This is true of the low-frequency patch 2, and an arbitrary polarized wave is transmitted and received through the pair of power feeding portions $P_{2A}$ and $P_{2B}$.

In a laminated patch antenna that resonates with a plurality of frequencies, a plurality of patches are provided at positions adjacent to each other for miniaturization, and thus the plurality of patches may interfere each other in accordance with frequencies that are used. In the antenna device 100, the slits 24-1 to 24-4 or the inter-patch connection portion 12 is formed, and thus the interference or electromagnetic interference is effectively reduced. Accordingly, antenna characteristics such as gain may be improved.

In a simulation with respect to the antenna device, four kinds of antenna models are used in accordance with the existence or non-existence of the slits 24-1 to 24-4 and the existence or non-existence of the inter-patch connection portion 12. Any antenna model may include the ground plate, the high-frequency patch, and the low-frequency patch provided between the ground plate and the high-frequency patch.

FIG. 17 illustrates an example of classification of a graph illustrating a simulation result. FIG. 17 illustrates that a graph illustrating the simulation result corresponds to which model among the four kinds of antenna models. The antenna device 100 illustrated in FIG. 1 and the like corresponds to an antenna model including a slit **24-*i* (i=1 to 4), and the inter-patch connection portion 12**.

A graph illustrated with "lower patch $S_{11}$" illustrates a return loss in a case where a signal is fed to the low-frequency patch, for example, the second patch. The return loss is expressed by $S_{11}$ that is one of S parameters of two-terminal pair circuit. The return loss may be referred to as a reflection loss.

A graph illustrated with "higher patch $S_{11}$" illustrates a return loss in a case where a signal is fed to the high-frequency patch (first patch).

A graph illustrated with "lower patch $S_{12}$" illustrates a coupling coefficient in a case where a signal is fed to the low-frequency patch, for example, the second patch. The coupling coefficient is expressed with $S_{12}$ or $S_{21}$ which is one of S parameters of two-terminal pair circuit, and $S_{12}$ equals to $S_{21}$ in a linear system. The coupling coefficient may be referred to as an insertion loss. For example, a graph of the lower patch $S_{12}$ illustrates a signal component that leaks toward the high-frequency patch 1 side from the low-frequency patch 2.

A graph illustrated with "higher patch $S_{21}$" illustrates a coupling coefficient in a case where a signal is fed to the high-frequency patch, for example, the first patch. For example, the graph of the higher patch $S_{21}$ illustrates a signal component that leaks toward the low-frequency patch 2 side from the high-frequency patch 1.

A graph illustrated with "higher patch gain" illustrates a gain [dBi] in a case where a signal is fed to the high-frequency patch, for example, the first patch. The gain [dBi] indicates energy in the maximum electric wave radiation direction, and is set based on a virtual isotropic antenna.

Figure 18:
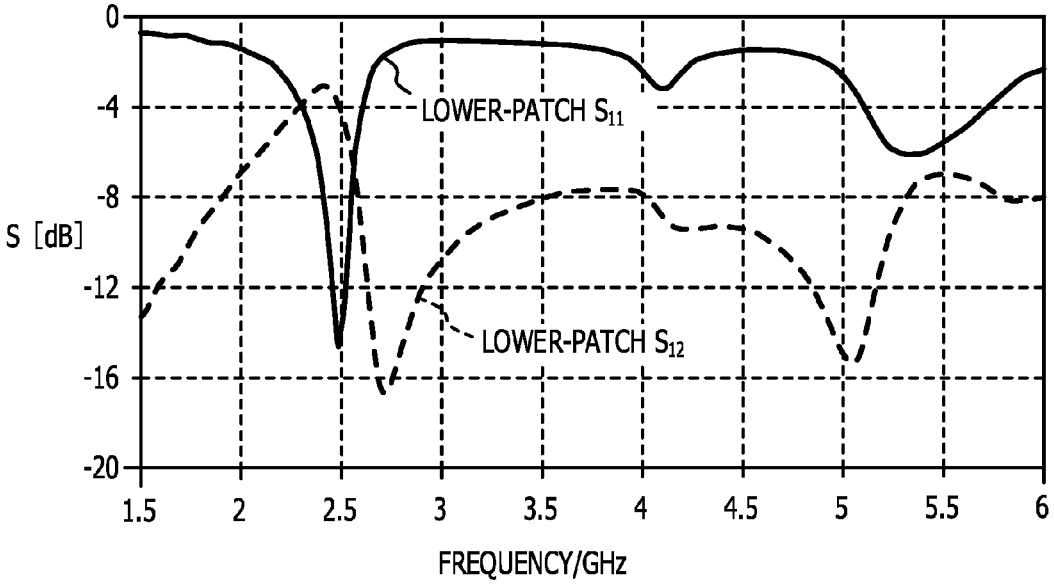
FIG. 18 illustrates an example of frequency dependency of a return loss and a coupling coefficient.

FIG. 18 illustrates an example of frequency dependency of a return loss and a coupling coefficient. FIG. 18 illustrates the frequency dependency of the return loss (lower patch $S_{11}$) and the coupling coefficient (lower patch $S_{12}$) in a case where a signal is fed to the low-frequency patch of an antenna model in which the slit and the inter-patch connection portion are not provided. The return loss (lower patch $S_{11}$) decreases to approximately −14 dB in the vicinity of approximately 2.45 GHz, and resonance occurs. In the vicinity of approximately 2.45 GHz, the coupling coefficient (lower patch $S_{12}$) increases to a value exceeding approximately −4 dB. Accordingly, power fed to the low-frequency patch may leak toward the high-frequency patch side.

Figure 19:
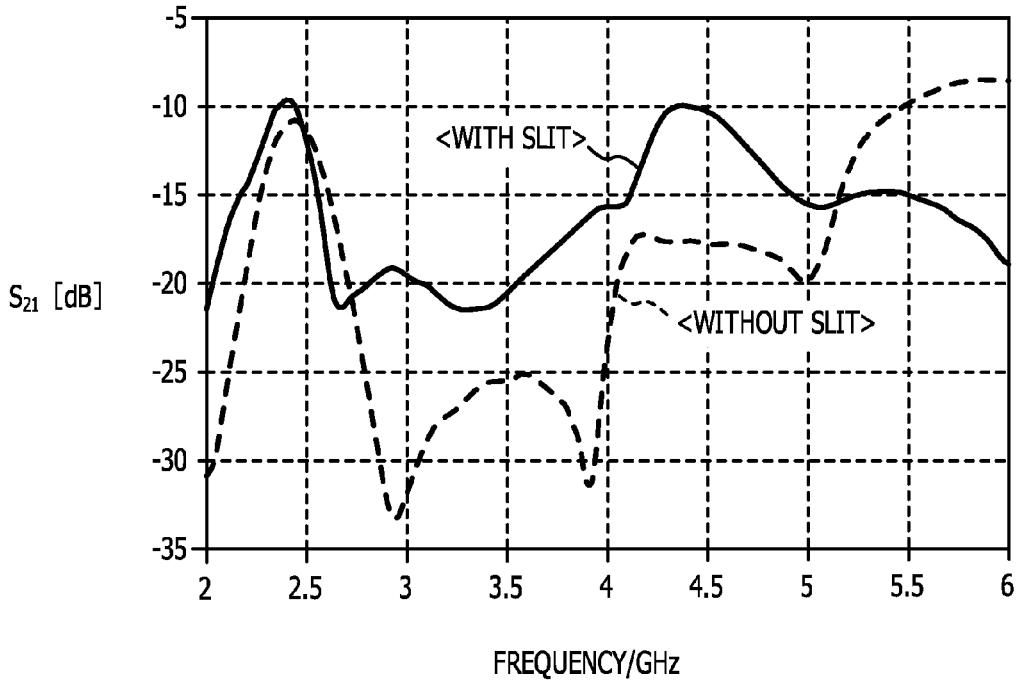
FIG. 19 illustrates an example of frequency dependency of a coupling coefficient.

FIG. 19 illustrates an example of frequency dependency of a coupling coefficient. FIG. 19 illustrates the frequency dependency of the coupling coefficient (higher patch $S_{21}$) in a case where a signal is fed to the high-frequency patch. A graph of "without slit" illustrates the coupling coefficient in a case where a signal is fed to the high-frequency patch of an antenna model in which the slit is not provided but the inter-patch connection portion is provided. A graph of "with slit" illustrates the coupling coefficient in a case where a signal is fed to the high-frequency patch of an antenna model in which the slit and the inter-patch connection portion are provided, for example, the antenna device 100 illustrated in FIG. 1 and the like. In a case of "without slit", the coupling coefficient $S_{21}$ is approximately −15 dB at approximately 5.2 GHz. The coupling coefficient $S_{21}$ increases as the frequency increases, and exceeds −10 dB at approximately 5.5 GHz or higher. In a case of "with slit", the coupling coefficient becomes approximately −15 dB from approximately 5 GHz to approximately 5.5 GHz, and decreases as the frequency increases from approximately 5.5 GHz. Accordingly, with regard to a frequency band of at least 5 GHz, when the slit **24-*i*** (i=1 to 4) is formed in the antenna device, the coupling coefficient $S_{21}$ of the high-frequency patch with respect to the low-frequency patch may be effectively reduced.

Figure 20:
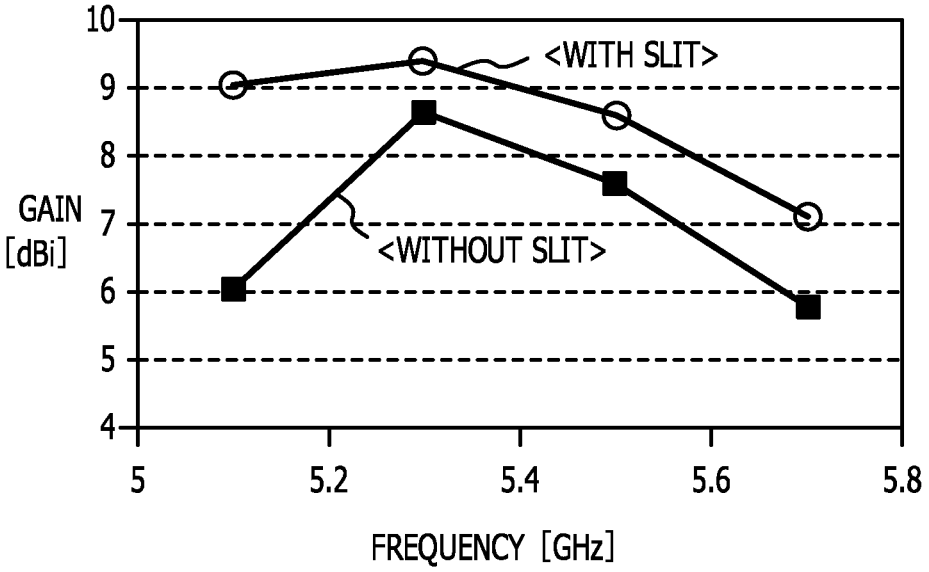
FIG. 20 illustrates an example of frequency dependency of a gain.

FIG. 20 illustrates an example of frequency dependency of a gain. FIG. 20 illustrates the frequency dependency of the gain in a case where a signal is fed to the high-frequency patch. A case of "without slit" and a case of "with slit" may be similar to the cases illustrated in FIG. 19. In a frequency range from approximately 5.1 GHz to approximately 5.7 GHz, the case of "with slit" has a gain that is more excellent than that in the case of "without slit" by approximately 1 dBi or more.

Figure 21:
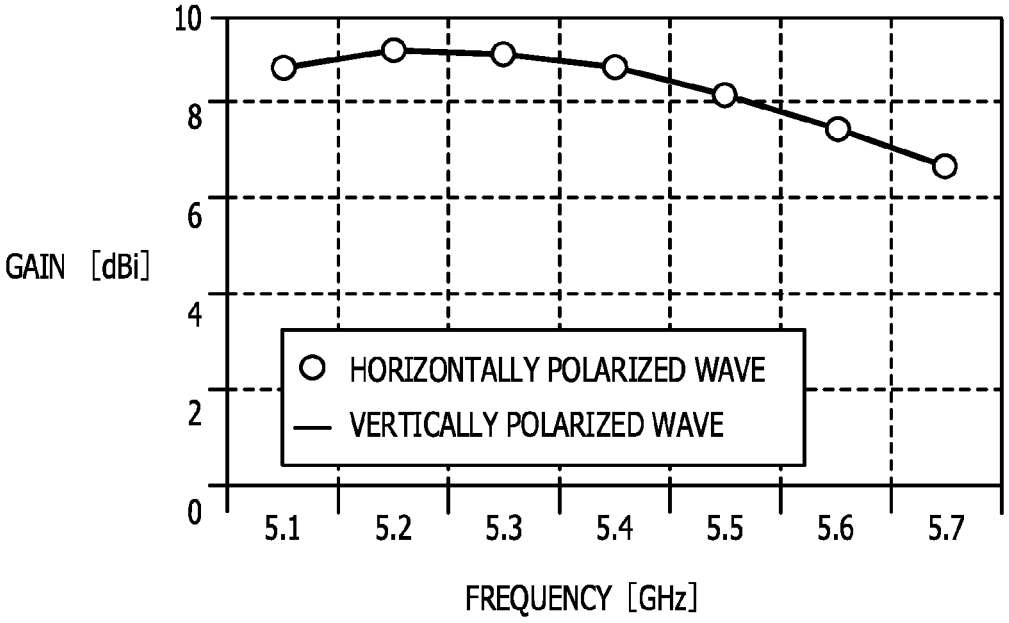
FIG. 21 illustrates an example of frequency dependency of a gain.

FIG. 21 illustrates an example of frequency dependency of a gain. In FIG. 21, the frequency dependency of the gain in a case where a signal is fed to the high-frequency patch is illustrated for each of a horizontally polarized wave and a vertically polarized wave. The antenna model may be an antenna model in which the slit and the inter-patch connection portion are provided, for example, the antenna device 100 illustrated in FIG. 1 and the like. For example, a signal may be fed to only one of the pair of power feeding portions $P_{1A}$ and $P_{1B}$ of the high-frequency patch 1, for example, only the $P_{1B}$, and a horizontally polarized wave, for example, an electric wave in which an amplitude direction of an electric field follows the x-axis direction may be generated. A signal may be fed to only one of the pair of power feeding portions $P_{1A}$ and $P_{1B}$ of the high-frequency patch 1, for example, only $P_{1A}$, and a vertically polarized wave, for example, an electric wave in which an amplitude direction of an electric field follows the y-axis direction may be generated. As illustrated in FIG. 21, the horizontally polarized wave and the vertically polarized wave have gains which are substantially the same in a range from approximately 5.1 GHz to approximately 5.7 GHz. Accordingly, in the antenna device 100, polarized wave control for transmission and reception of various polarized waves may be appropriately executed to equally control the horizontally polarized wave and the vertically polarized wave.

Figure 22:
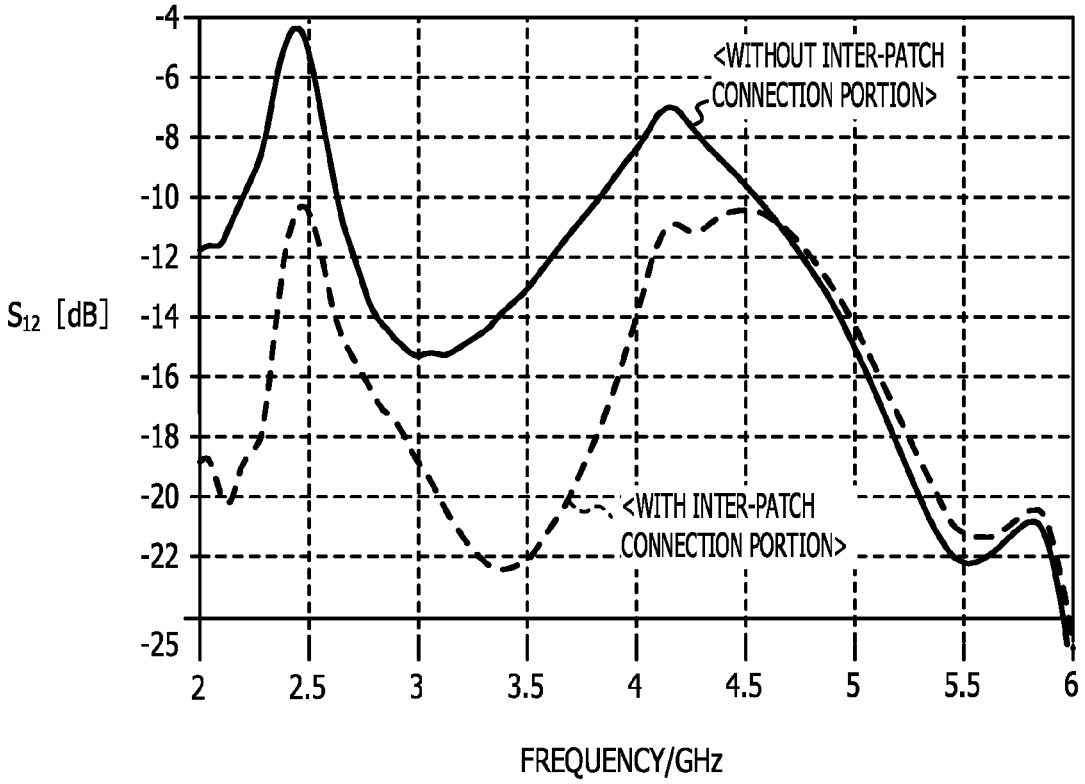
FIG. 22 illustrates an example of frequency dependency of a coupling coefficient.

FIG. 22 illustrates an example of frequency dependency of a coupling coefficient. FIG. 22 illustrates the frequency dependency of the coupling coefficient (lower patch $S_{12}$) in a case where a signal is fed to the low-frequency patch. A graph of "without inter-patch connection portion" illustrates the coupling coefficient $S_{12}$ in a case where a signal is fed to the low-frequency patch of an antenna model in which the slit is provided but the inter-patch connection portion is not provided. A graph of "with inter-patch connection portion" illustrates the coupling coefficient $S_{12}$ in a case where a signal is fed to the low-frequency patch of an antenna model in which the slit and the inter-patch connection portion are provided, for example, the antenna device 100 illustrated in FIG. 1 and the like. In the case of "without inter-patch connection portion", the coupling coefficient $S_{12}$ increases as the frequency increases from approximately 2 GHz, decreases after reaching approximately −4 dB in the vicinity of approximately 2.45 GHz, and decreases to approximately −15 dB at approximately 3 GHz. In the case of "with inter-patch connection portion", the coupling coefficient $S_{12}$ also increases as the frequency increases from approximately 2.1 GHz. However, the coupling coefficient $S_{12}$ merely becomes approximately −10 dB in the vicinity of approximately 2.45 GHz, and then decreases up to approximately −23 dB at approximately 3.4 GHz. Accordingly, with regard to a frequency band of at least 2 GHz, when the inter-patch connection portion 12 is provided, the coupling coefficient $S_{12}$ of the low-frequency patch with respect to the high-frequency patch may be reduced.

Figure 23:
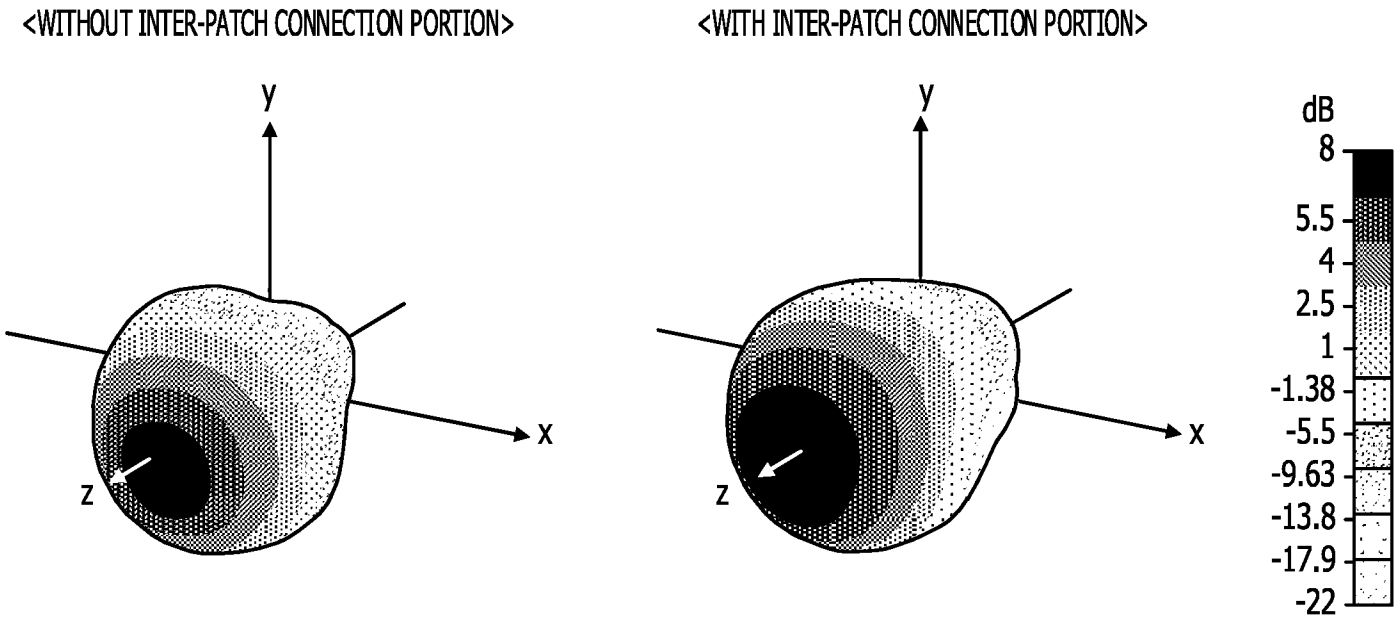
FIG. 23 illustrates an example of energy intensity of an electric wave.

FIG. 23 illustrates an example of an energy intensity of an electric wave. The energy intensity of an electric wave, which is radiated in a case where a signal of a frequency of approximately 2.45 GHz is fed to the low-frequency patch, is illustrated in FIG. 23. A case of "without inter-patch connection portion" illustrated on a left side of FIG. 23 illustrates a beam that is radiated in a case where a signal is fed to the low-frequency patch of an antenna model in which the slit is provided but the inter-patch interconnection portion is not provided. The beam obtains a gain of approximately 6.9 dBi. A case of "with inter-patch connection portion" which is illustrated on a right side of FIG. 23 illustrates a beam that is radiated in a case where a signal is fed to an antenna model in which the slit and the inter-patch connection portion are provided, for example, the low-frequency patch of the antenna device 100 illustrated in FIG. 1 and the like. The beam obtains a gain of approximately 7.9 dBi. According to this, with regard to a frequency band of at least 2 GHz, when the inter-patch connection portion 12 is provided, the gain may be improved.

Figure 24:
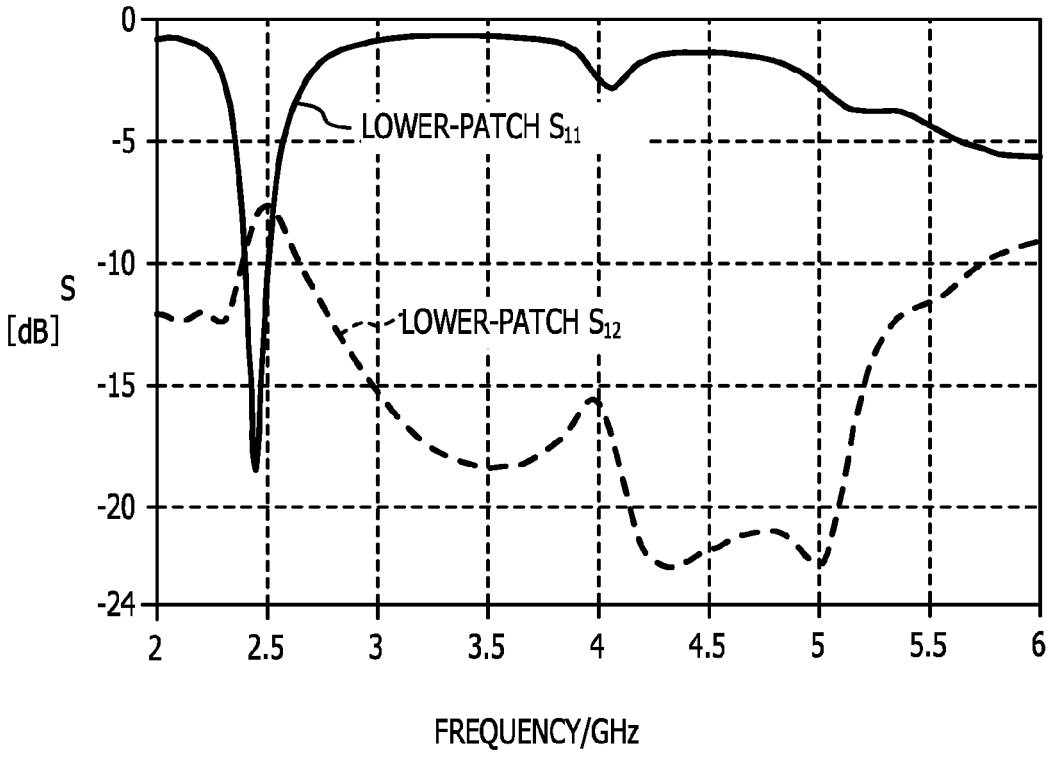
FIG. 24 illustrates an example of frequency dependency of a return loss and a coupling coefficient.

FIG. 24 illustrates an example of frequency dependency of a return loss and a coupling coefficient. FIG. 24 illustrates the frequency dependency, the return loss (lower patch $S_{11}$), and the coupling coefficient (lower patch $S_{12}$) in a case where a signal is fed to the low-frequency patch. An antenna model in which the slit is not provided but the inter-patch connection portion is provided is used. The return loss (lower patch $S_{11}$) decreases to approximately −18 dB in the vicinity of approximately 2.45 GHz, and resonance occurs. The coupling coefficient (lower patch $S_{12}$) is approximately −7.5 dB in the vicinity of approximately 2.45 GHz. The coupling coefficient (lower patch $S_{12}$) is relatively great, approximately −12 dB, in the vicinity of approximately 5.3 GHz at which the high-frequency patch operates. According to this, a high-frequency component among signals to be fed to the low-frequency patch may slightly leak to the high-frequency patch.

Figure 25:
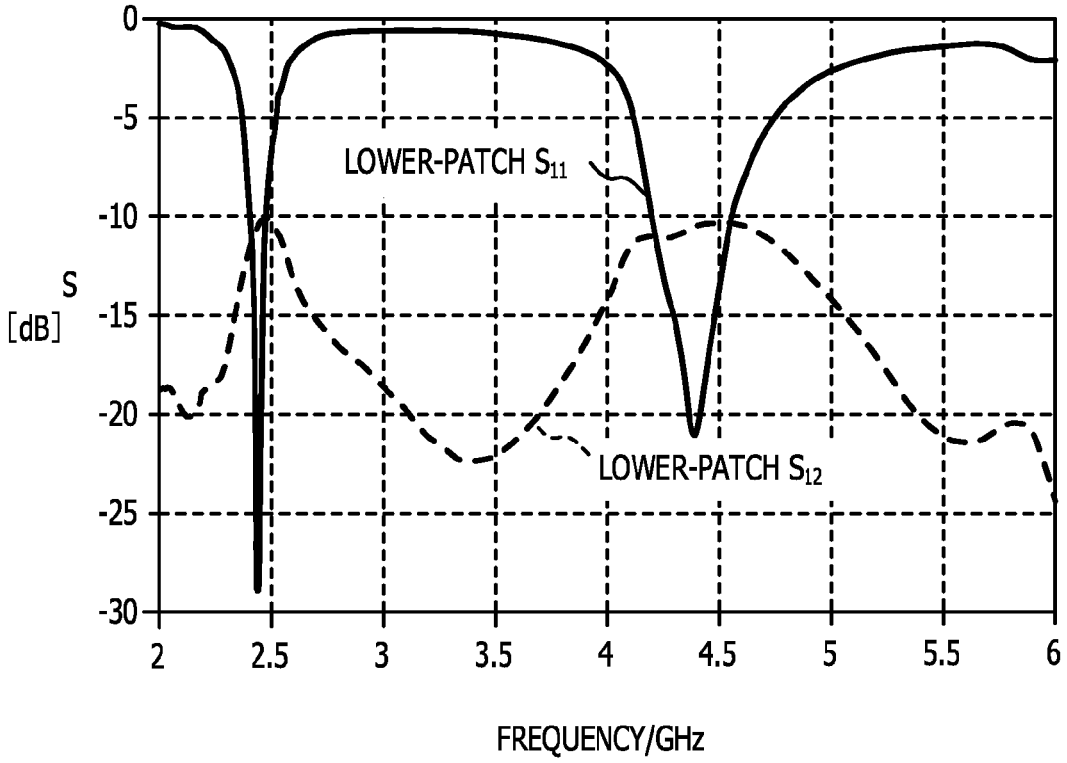
FIG. 25 illustrates an example of frequency dependency of a return loss and a coupling coefficient.

FIG. 25 illustrates an example of frequency dependency of a return loss and a coupling coefficient. FIG. 25 illustrates the frequency dependency of the return loss (lower patch $S_{11}$) and the coupling coefficient (lower patch $S_{12}$) in a case where a signal is fed to the low-frequency patch. An antenna model in which the slit and the inter-patch connection portion are provided, for example, the antenna device 100 illustrated in FIG. 1 and the like may be used. A graph of the coupling coefficient (lower patch $S_{12}$) illustrated in FIG. 25 may be substantially the same as the graph of "with inter-patch connection portion" illustrated in FIG. 22. The return loss (lower patch $S_{11}$) decreases to approximately −28 dB in the vicinity of approximately 2.45 GHz, and resonance occurs. The return loss (lower patch $S_{11}$) also decreases to approximately −20 dB in the vicinity of approximately 4.4 GHz. However, differently from the example illustrated in FIG. 24, the return loss in the vicinity of approximately 5.3 GHz with which the high-frequency patch operates is retained to be high. The coupling coefficient (lower patch $S_{12}$) is suppressed to approximately −10 dB in the vicinity of approximately 2.45 GHz. Unlike in the example illustrated in FIG. 24, the coupling coefficient (lower patch $S_{12}$) is suppressed to a value as small as approximately −22 dB in the vicinity of approximately 5.3 GHz with which the high-frequency patch operates. Accordingly, in a case where a signal is fed to the low-frequency patch, coupling may be suppressed not only in the vicinity of approximately 2.45 GHz but also in the vicinity of approximately 5 GHz.

Figure 26:
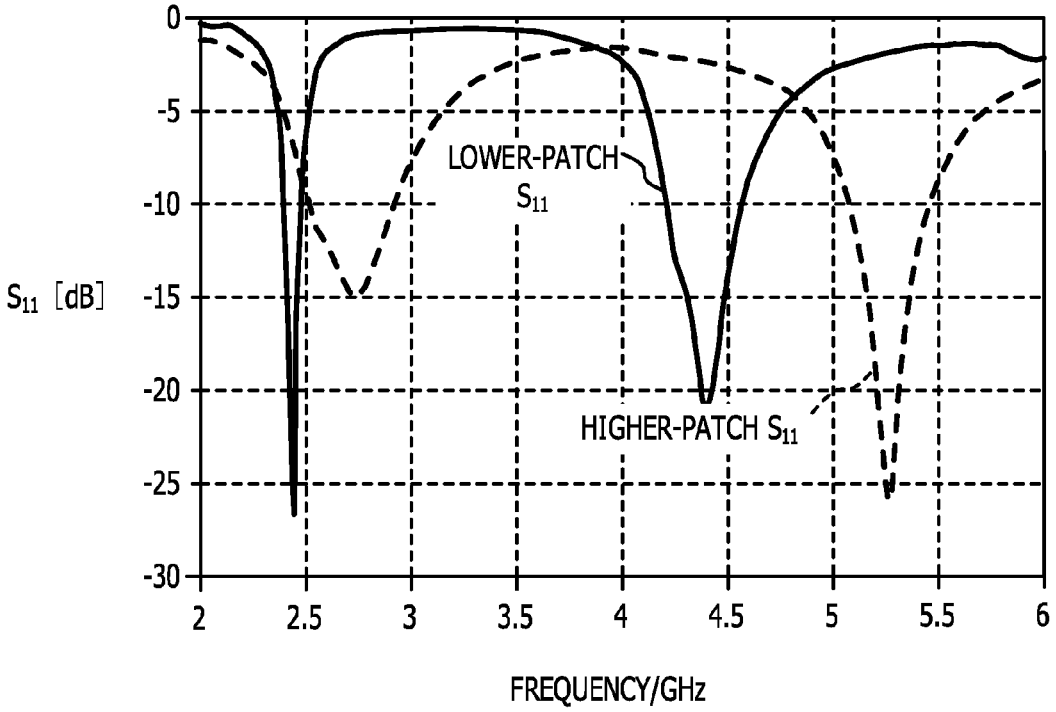
FIG. 26 illustrates an example of a return loss with respect to a low-frequency patch and a return loss with respect to a high-frequency patch.

FIG. 26 illustrates an example of a return loss with respect to a low-frequency patch and a return loss with respect to the high-frequency patch. FIG. 26 illustrates the return loss (lower patch $S_{11}$) with respect to the low-frequency patch and the return loss (higher patch $S_{11}$) with respect to the high-frequency patch of the antenna device 100 illustrated in FIG. 1 and the like. A graph of the return loss (lower patch $S_{11}$) illustrated in FIG. 26 may be substantially the same as the graph of the return loss (lower patch $S_{11}$) illustrated in FIG. 25. The return loss (lower patch $S_{11}$) with respect to the low-frequency patch is as low as approximately −28 dB at a desired frequency of approximately 2.45 GHz, and resonance occurs with the frequency. The return loss (higher patch $S_{11}$) with respect to the high-frequency patch is as low as approximately −26 dB at a desired frequency of approximately 5.3 GHz, and resonance occurs with the frequency.

The low-frequency patch 2 may resonate with approximately 2.45 GHz (FIG. 26), and the coupling coefficient (lower patch $S_{12}$) of the low-frequency patch 2 with respect to the high-frequency patch 1 may be reduced in the vicinity of approximately 2.45 GHz and approximately 5 GHz, (FIG. 25). The high-frequency patch 1 may resonate in the vicinity of approximately 5.3 GHz (FIG. 26), and the coupling coefficient (higher patch $S_{21}$) of the high-frequency patch 1 with respect to the low-frequency patch 2 may be reduced in the vicinity of approximately 5.3 GHz ("with slit" in FIG. 19).

As shown in a simulation result, in the antenna device 100, the slits 24-1 to 24-4 and the inter-patch connection portion 12 are formed, and thus coupling between patches is suppressed, and thus antenna characteristics such as a gain may be improved.

The slits 24-1 to 24-4 are formed by partially removing a conductive material of the low-frequency patch 2 (second patch 2), and thus a kind of opening is formed between the high-frequency patch 1 (first patch 1) and the ground plate G. In the opening, the conductive material of the low-frequency patch 2 is partially removed, and thus coupling between the high-frequency patch 1 and the low-frequency patch 2 may be suppressed. The opening promotes a mutual operation between the high-frequency patch 1 and the ground plate G, for example, appropriate formation of a line of electric force which ranges from the ground plate G to an end of the high-frequency patch 1, and the like. According to this, the high-frequency patch 1 may appropriately transmit and receive an electric wave. To promote an operation of the high-frequency patch 1 by suppressing coupling between the high-frequency patch 1 and the low-frequency patch 2, a wide opening may be formed in the slit.

An electromagnetic field that is generated between the high-frequency patch 1 and the low-frequency patch 2 is stronger on an end side in comparison to the central portion, and thus an electromagnetic field that occurs at the end has a greater effect on an electric wave, which is transmitted and received, in comparison to the central portion. To promote an operation of the high-frequency patch 1, at least the end of the high-frequency patch 1 may overlap the slit in a plane view.

On the other hand, the degree of suppression of the coupling between the high-frequency patch 1 and the low-frequency patch 2 may be adjusted by an area of the opening formed by the slit, and the like. For example, the slit width w and the slit length (Dx, Dy, and the like) which are described in FIGS. 6 to 8 may be adjusted. For example, the slit width w may be narrow so as to adjust the degree of suppression of the coupling between the high-frequency patch 1 and the low-frequency patch 2 in detail over a wide range. When the slit width w is excessively narrow, a function as the opening is less likely to be exhibited, and thus the slit width w may be large to a certain degree.

In a case where the slit and the inter-patch connection portion are not provided, the high-frequency patch functions like a passive element with respect to the low-frequency patch. Accordingly, a signal that is fed to the low-frequency patch may leak to the high-frequency patch in accordance with a frequency. For example, as illustrated in FIG. 18, in a case where the slit and the inter-patch connection portion are not provided, the coupling coefficient $S_{12}$ is relatively large not only in the vicinity of approximately 2.45 GHz but also in the vicinity of approximately 5.3 GHz, and thus loss due to leakage may occur. When the inter-patch connection portion 12 directly couples the high-frequency patch 1 and the low-frequency patch 2, a circuit constant, which allows resonance or coupling to occur, is changed in comparison to a case where the inter-patch connection portion 12 does not exist. As illustrated in FIG. 25, the coupling coefficient (lower patch $S_{12}$) in a case of feeding power to the low-frequency patch 2 is suppressed to a value as low as approximately −22 dB at a frequency of approximately 5.5 GHz, and thus with regard to a frequency in the vicinity of the above-described frequency, coupling of the low-frequency patch 2 to the high-frequency patch 1 may be effectively suppressed.

The antenna device 100 may resonate with two frequencies or three or more frequencies. The number of patches which are provided on the ground plate G of the antenna device 100 may be two, or three or more.

Figure 27:
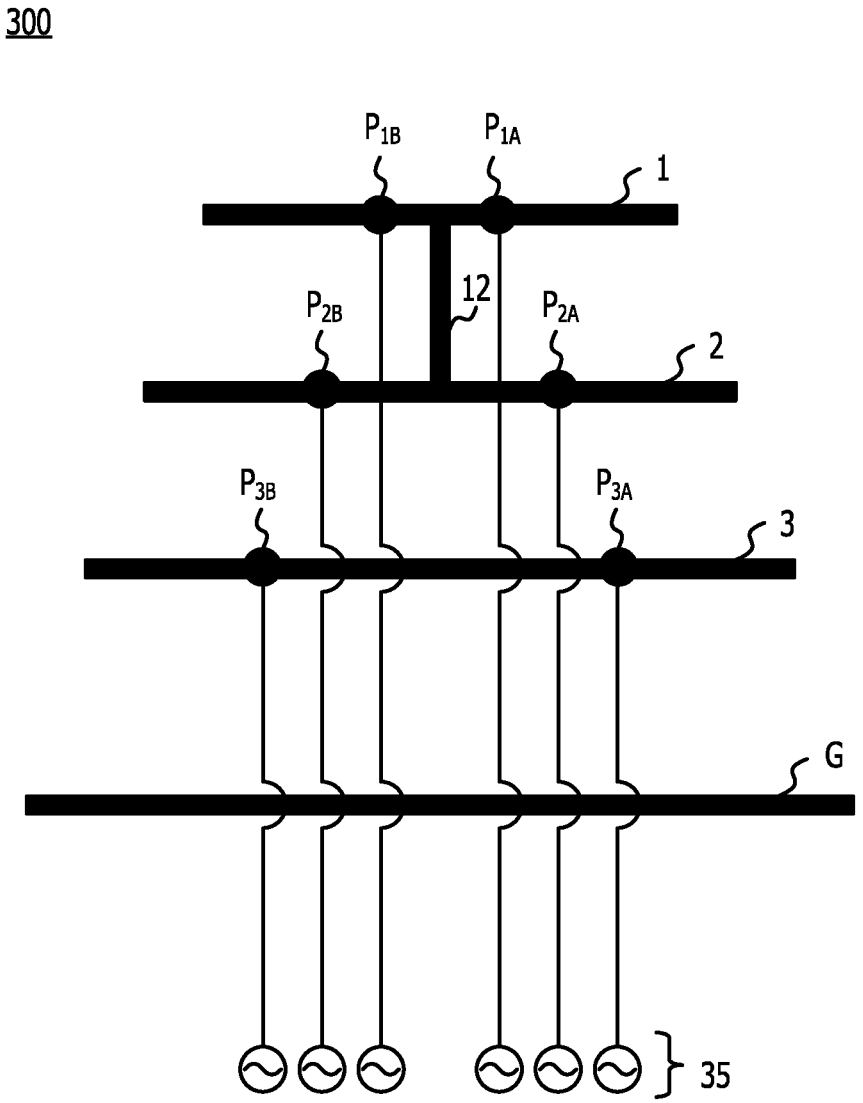
FIG. 27 illustrates an example of an antenna device.

FIG. 27 illustrates an example of an antenna device. In FIG. 27, a circuit diagram of an antenna device 300 is illustrated. The antenna device 300 includes a ground plate G, a first patch 1 that is provided at a position spaced away from the ground plate G with a certain distance, a second patch 2 that is provided between the first patch 1 and the ground plate G, and a third patch 3 that is provided between the second patch and the ground plate G. Power is fed to the first patch 1 by a pair of power feeding portions $P_{1A}$ and $P_{1B}$, and the first patch 1 resonates with a first frequency. Power is fed to the second patch 2 by a pair of power feeding portions $P_{2A}$ and $P_{2B}$, and the second patch 2 resonates with a second frequency. Power is fed to the third patch 3 by a pair of power feeding portions $P_{3A}$ and $P_{3B}$, and the third patch 3 resonates with a third frequency. In FIG. 27, the first and second patches 1 and 2 are coupled by an inter-patch connection portion 12. Alternatively or additionally, the second and third patches 2 and 3 may be coupled by an inter-patch connection portion. The first, second, and third frequencies may be different from each other, and among the three frequencies, two frequencies may be the same as each other. The first frequency may be higher than the third frequency, and the second frequency may be equal to or lower than the first frequency and equal to or higher than the third frequency.

Figure 28:
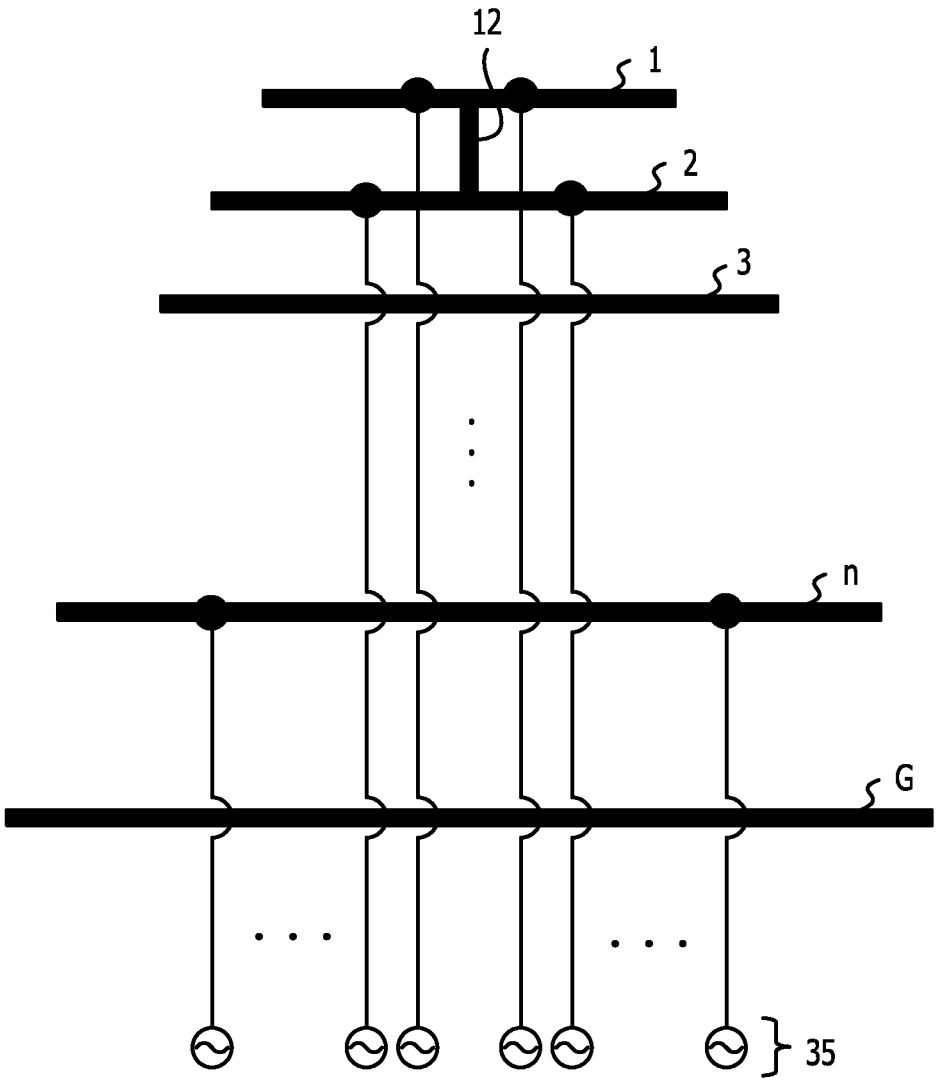
FIG. 28 illustrates an example of n patches.

FIG. 28 illustrates an example of n patches. FIG. 28 illustrates a case where n patches 1, . . . , and n exist on the ground plate G. n may be an integer of two or greater. With regard to an arbitrary k that is equal to or greater than 1 and equal to or less than (n−1). A $k^{th}$ patch k and a $(k+1)^{th}$ patch (k+1) may be coupled by an inter-patch connection portion. Frequencies with which individual patches resonate may be different from each other. Two or more frequencies may be the same as each other (case of n≥3). A frequency with which the first patch 1 resonates is higher than a frequency with which an $n^{th}$ patch n resonates, and a frequency with which the $k^{th}$ patch resonates is equal to or higher than a frequency with which the $(k+1)^{th}$ patch resonates.

Figure 29:
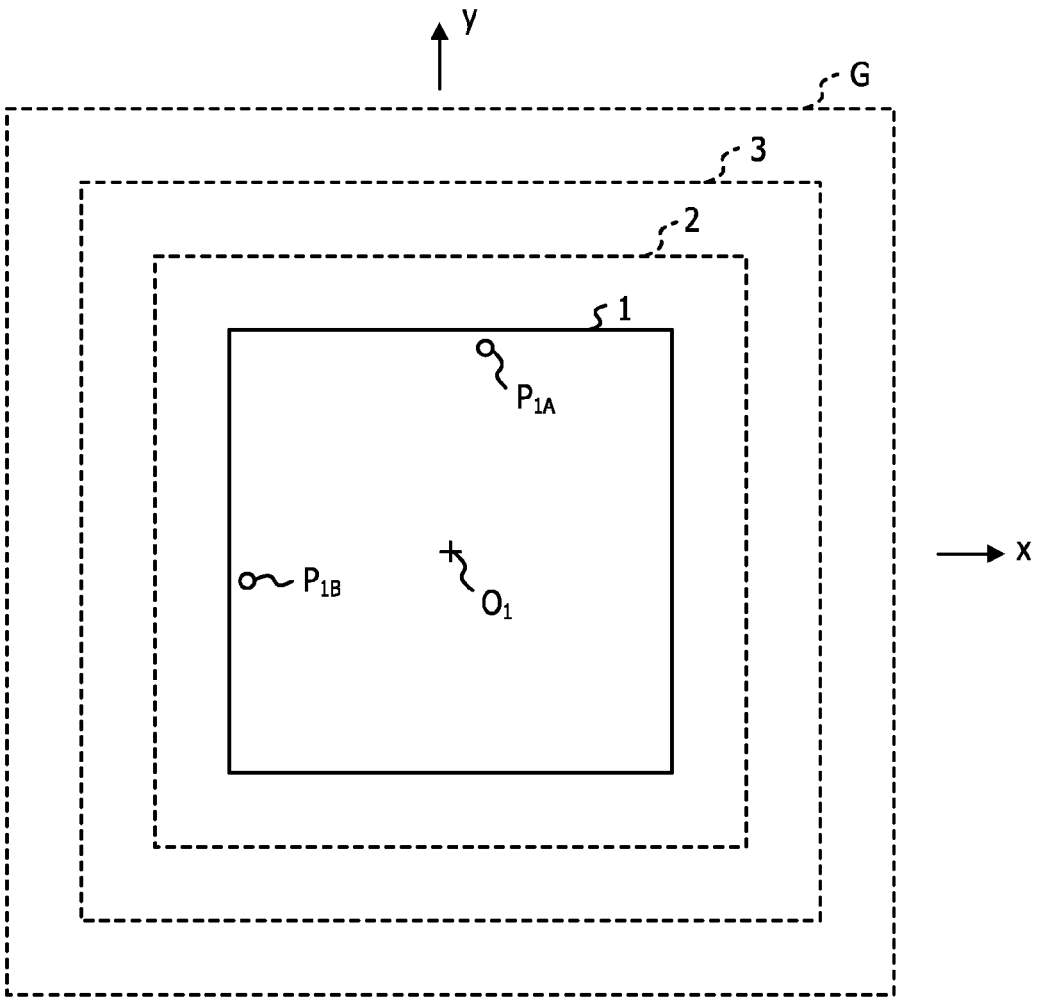
FIG. 29 illustrates an example of a first patch.
Figure 30:
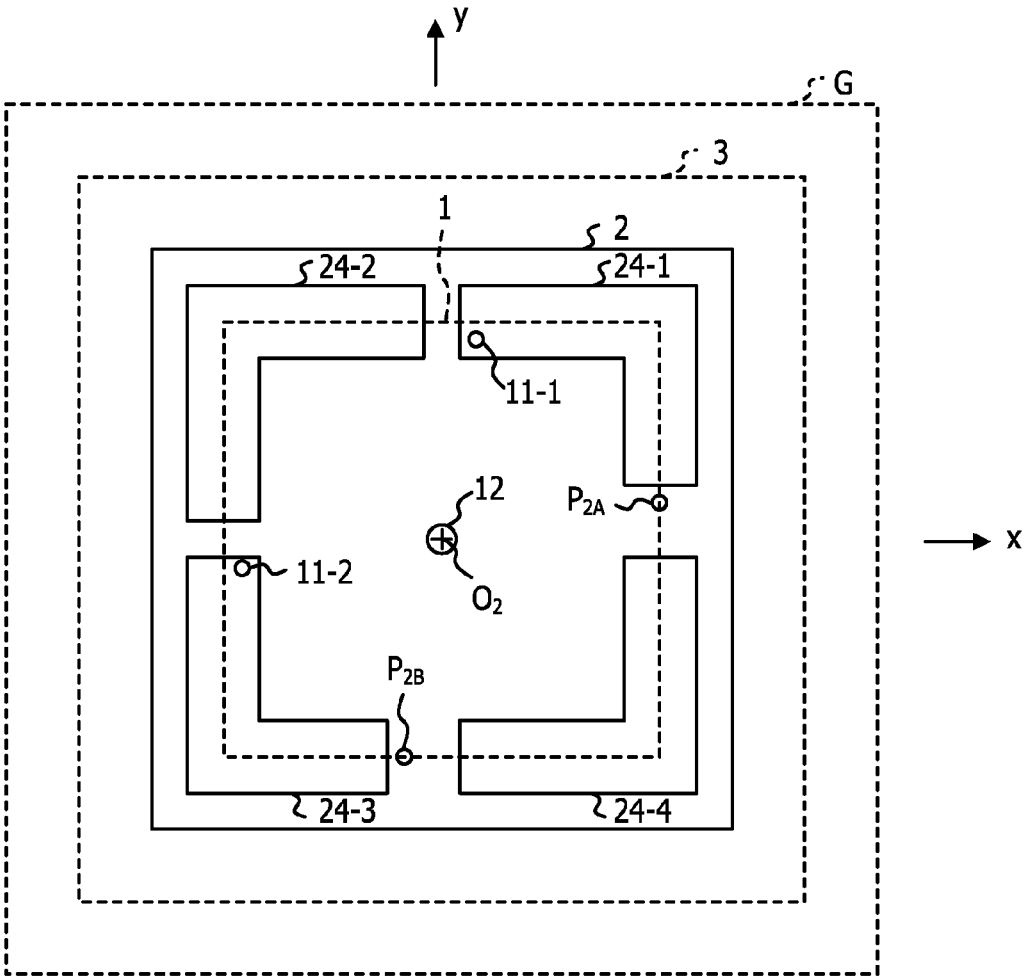
FIG. 30 illustrates an example of a second patch.
Figure 31:
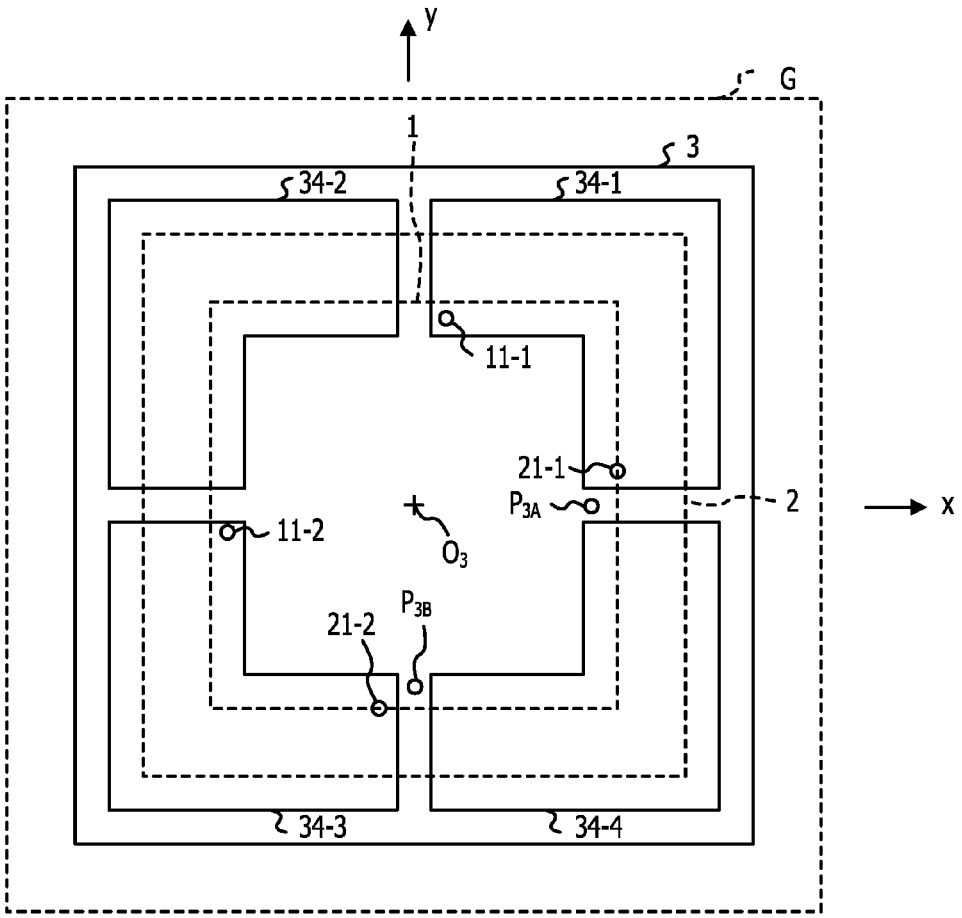
FIG. 31 illustrates an example of a third patch.
Figure 32:
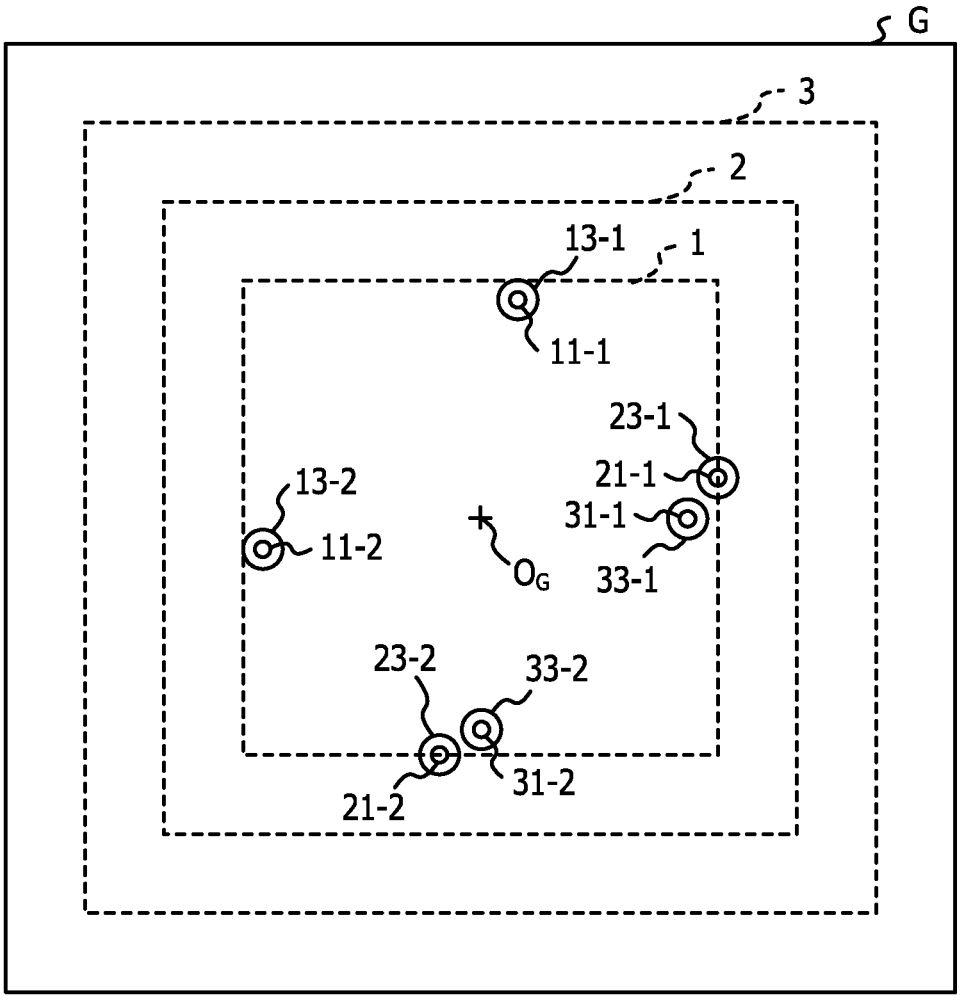
FIG. 32 illustrates an example of a ground plate.

FIG. 29 illustrates an example of a first patch. FIG. 30 illustrates an example of a second patch. FIG. 31 illustrates an example of a third patch. FIG. 32 illustrates an example of a ground plate. In FIGS. 29 to 32, plan views of a plurality of conductive layers of the antenna device 300 as illustrated in FIG. 27 are illustrated. The plurality of conductive layers include the first to third patches 1, 2, and 3, and the ground plate G.

In FIG. 29, a plan view of the first patch 1 of the antenna device 300 is illustrated. The first patch 1 has a shape (square shape in FIG. 29) symmetric about the center $O_1$ that is positioned on the z-axis, and resonates with the first frequency. The first patch 1 includes a pair of power feeding portions $P_{1A}$ and $P_{1B}$. The power feeding portion $P_{1A}$ on one side may be positioned at an end portion of a first quadrant which is close to the y-axis, the power feeding portion $P_{1B}$ on the other side may be positioned at an end portion of a third quadrant which is close to the x-axis, and an angle $P_{1A}O_1P_{1B}$ may be substantially 90°. When the voltage and the phase of a signal that flows to each of the pair of power feeding portions $P_{1A}$ and $P_{1B}$ are controlled, various polarized waves may be transmitted and received.

In FIG. 30, a plan view of the second patch 2 of the antenna device 300 is illustrated. The second patch 2 has a shape (square shape in FIG. 30) symmetric about the center $O_2$ that is positioned on the z-axis, and resonates with the second frequency. The second patch 2 may have a shape which is larger than that of the first patch 1. The second patch 2 includes a pair of power feeding portions $P_{2A}$ and $P_{2B}$. The power feeding portion $P_{2A}$ on one side may be positioned at an end portion of a first quadrant which is close to the x-axis, the power feeding portion $P_{2B}$ on the other side may be positioned at an end portion of a third quadrant which is close to the y-axis, and an angle $P_{2A}O_2P_{2B}$ may be substantially 90°. When the voltage and the phase of a signal that flows to each of the pair of power feeding portions $P_{2A}$ and $P_{2B}$ are controlled, various polarized waves may be transmitted and received.

The second patch 2 includes first to fourth L-shaped slits 24-1 to 24-4 which conform to the contour of the first patch 1 in the first to fourth quadrants. The power feeding line 11-1, which is coupled to the power feeding portion $P_{1A}$ on one side of the first patch 1, penetrates through the first slit 24-1. The power feeding line 11-2, which is coupled to the power feeding portion $P_{1B}$ on the other side of the first patch 1, penetrates through the third slit 24-3.

At the central portion including the center $O_2$, the second patch 2 is coupled to the central portion of the first patch 1 by the inter-patch connection portion 12.

In FIG. 31, a plan view of the third patch 3 of the antenna device 300 is illustrated. The third patch 3 has a shape (square shape in FIG. 31) symmetric about the center $O_3$ that is positioned on the z-axis, and resonates with the third frequency. The third patch 3 may have a shape larger than that of the second patch 2.

The third patch 3 includes first to fourth L-shaped slits 34-1 to 34-4 which conform to the contour of the second patch 2 in the first to fourth quadrants. The power feeding line 11-1, which is coupled to the power feeding portion $P_{1A}$ on one side of the first patch 1, penetrates through the first slit 34-1 at a position of the first quadrant which is close to the y-axis. The power feeding line 21-1, which is coupled to the power feeding portion $P_{2A}$ on one side of the second patch 2, penetrates through the first slit 34-1 at a position of the first quadrant which is close to the x-axis. The power feeding line 11-2, which is coupled to the power feeding portion $P_{1B}$ on the other side of the first patch 1, penetrates through the third slit 34-3 at a position of the third quadrant which is close to the x-axis. The power feeding line 21-2, which is coupled to the power feeding portion $P_{2B}$ on the other side of the second patch 2, penetrates through the third slit 34-3 at a position of the third quadrant which is close to the y-axis.

The third patch 3 includes a pair of power feeding portions $P_{3A}$ and $P_{3B}$. The power feeding portion $P_{3A}$ on one side is positioned on the x-axis which is close to the power feeding line 21-1 between the first slit 34-1 and the fourth slit 34-4. The power feeding portion $P_{3B}$ on the other side is positioned on the y-axis which is close to the power feeding line 21-2 between the third slit 34-3 and the fourth slit 34-4. With regard to the pair of power feeding portions $P_{3A}$ and $P_{3B}$, an angle $P_{3A}O_3P_{3B}$ may be substantially 90°. When the voltage and the phase of a signal that flows to each of the pair of power feeding portions $P_{3A}$ and $P_{3B}$ are controlled, various polarized waves may be transmitted and received.

In FIG. 32, a plan view of the ground plate G of the antenna device 300 is illustrated. The two power feeding lines 11-1 and 11-2, which are coupled to the pair of power feeding portions $P_{1A}$ and $P_{1B}$ of the first patch 1, pass through penetration holes 13-1 and 13-2, respectively, penetrate through the ground plate G, and are coupled to a power feeding circuit in FIG. 32. The two power feeding lines 21-1 and 21-2, which are coupled to the pair of power feeding portions $P_{2A}$ and $P_{2B}$ of the second patch 2, pass through penetration holes 23-1 and 23-2, respectively, penetrate through the ground plate G, and are coupled to the power feeding circuit in FIG. 32. The two power feeding lines 31-1 and 31-2, which are coupled to the pair of power feeding portions $P_{3A}$ and $P_{3B}$ of the third patch 3, pass through penetration holes 33-1 and 33-2, respectively, penetrate through the ground plate G, and are coupled to the power feeding circuit in FIG. 32.

Positional relationships of the six power feeding lines illustrated in FIGS. 29 to 32 are illustrative only, and other appropriate arrangements may be used.

In the antenna device, a laminated patch antenna in which a plurality of patches are laminated is formed, and the size of the patches gradually decreases as it goes away from the ground plate, and a patch that is far away from the ground plate resonates with a frequency higher than that of a patch that is close to the ground plate. When the patches are laminated, an area occupied by the antenna device corresponds to an area of one patch, and thus simplification and miniaturization of the antenna device may be achieved.

The plurality of patches are laminated with a positional relationship in which the centers are aligned, and thus power is fed to the plurality of patches by a pair of power feeding portions. When lamination is performed by aligning the centers of the patches, a horizontally polarized wave and a vertically polarized wave are controlled in a substantially equal manner, and thus control of polarized waves may be appropriately executed in the antenna device.

The second patch 2 that is positioned between the first patch 1 and the ground plate G includes the slits 24-1 to 24-4, and thus an opening is formed between the first patch 1 and the ground plate G. The opening is formed by removing a part of the second patch 2, and thus coupling between the first patch 1 and the second patch 2 in the antenna device may be suppressed. A mutual operation between the first patch 1 and the ground plate G is promoted through the opening, and thus an operation of the first patch 1 in the antenna device may be promoted.

The first patch and the second patch are coupled to each other by the inter-patch connection portion, and thus a circuit constant during operation of the second patch is different from a circuit constant in a case where the inter-patch connection portion does not exist. In the antenna device, when changing the circuit constant during operation of the second patch, coupling between the first patch and the second patch may be suppressed.

In the antenna device, the coupling between the first patch and the second patch is suppressed, and thus antenna characteristics such as a gain may be improved.

The antenna device may resonate with frequencies of a frequency band of 2 GHz and a frequency band of 5 GHz. The embodiments disclosed herein are not limited to the above-described examples, and various modification examples, variations, alternative examples, substitution examples, and the like may be applied. The coordinates (and the coordinate system) which are used to explain geometrical positional relationships such as a structure and a shape are illustrative only, and other appropriate coordinates (and a coordinate system) may be used. The numerical values are illustrative only, and other appropriate values may be used.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device, comprising:

a ground plate including a plurality of through holes;

a first patch, provided on one surface side of the ground plate and including two first power feeding portions provided in a region surrounded by a first contour at positions spaced away from a first position with a first distance, configured to resonate with a first frequency;

two first power feeding lines coupled to the respective two first power feeding portions via the respective through holes of the plurality of through holes;

a second patch, provided between the ground plate and the first patch and including two second power feeding portions provided in a region surrounded by a second contour at positions spaced away from a second position with a second distance and a slit formed in the region, configured to resonate with a second frequency lower than the first frequency; and an inter-patch connection portion configured to electrically couple the first position of the first patch and the second position of the second patch.

2. The antenna device according to claim 1, wherein the first contour and the second contour have a shape which is symmetric about a center in a plan view.

3. The antenna device according to claim 2, wherein the first position is a center of the first contour, and the second position is a center of the second contour.

4. The antenna device according to claim 1, wherein the slit includes a plurality of sub-slits and the two first power feeding lines penetrate the respective sub-slits.

5. The antenna device according to claim 4, wherein each of the two first power feeding lines, which extend from the first two power feeding portions, is coupled to an inner conductor of a coaxial cable including an outer conductor coupled to the ground plate.

6. The antenna device according to claim 1, wherein a part of the first contour overlaps a region of the slit in a plan view.

7. The antenna device according to claim 1, wherein the inter-patch connection portion includes a plurality of lines which electrically couple a central portion of the first patch and a central portion of the second patch.

8. The antenna device according to claim 7, wherein the plurality of lines are provided at positions which are symmetric about a central line coupling a center of the first patch and a center of the second patch.

9. The antenna device according to claim 1, wherein the first contour has a rectangular shape or a circular shape, and the second contour has a rectangular shape or a circular shape.

10. The antenna device according to claim 9, wherein the first contour has a square shape, and the second contour has a circular shape.

11. The antenna device according to claim 1, wherein a linearly polarized wave or a circularly polarized wave is transmitted and received by the first patch, and the linearly polarized wave or the circularly polarized wave is transmitted and received by the second patch.

12. The antenna device according to claim 1, further comprising:

a third patch, provided between the ground plate and the second patch or between the first patch and the second patch and including a third contour having a shape which is symmetric about the center in a plan view, configured to resonate with a third frequency.

13. The antenna device according to claim 1, further comprising:

two second power feeding lines which are coupled to the two second power feeding portions, respectively, and penetrate through the ground plate.

14. The antenna device according to claim 1, wherein the inter-patch connection portion is provided on the opposite side to the ground plate and between the first patch and the second patch.

15. An antenna system, comprising:

a ground plate including a plurality of through holes;

a first patch, provided on a first surface side of the ground plate and including a first power feeding portion and a second power feeding portion, configured to resonate with a first frequency;

a second patch, provided between the ground plate and the first patch and including a third power feeding portion and a fourth power feeding portion, configured to resonate with a second frequency lower than the first frequency;

an inter-patch connection portion configured to electrically couple the first patch and the second patch;

a first power feeding line configured to penetrate through the second patch and the ground plate via a first through hole of the plurality of through holes from the first power feeding portion;

a second power feeding line configured to penetrate through the second patch and the ground plate via a second through hole of the plurality of through holes from the second power feeding portion;

a third power feeding line configured to penetrate through the ground plate via a third through hole of the plurality of through holes from the third power feeding portion; and a fourth power feeding line configured to penetrate through the ground plate via a fourth through hole of the plurality of through holes from the fourth power feeding portion, the first through hole.

16. The antenna system according to claim 15, wherein the first power feeding line to the fourth power feeding line are coupled to a power feeding circuit that is provided on a second surface side of the ground plate.

17. The antenna system according to claim 15, wherein the second patch has an opening through which the first power feeding line or the second power feeding line passes.

18. The antenna system according to claim 15, wherein the inter-patch connection portion is provided on the opposite side to the ground plate and between the first patch and the second patch.

19. The antenna system according to claim 15, wherein the second patch includes a plurality of slits, and the first power feeding line and the second power feeding line penetrate the respective slits.

* * * * *